US009993078B2

(12) United States Patent
Nicholson

(10) Patent No.: US 9,993,078 B2
(45) **Date of Patent: *Jun. 12, 2018**

(54) PRESSURE MOUNTED STORAGE APPARATUS

(71) Applicant: Jeffrey M Nicholson, Franklin, MA (US)

(72) Inventor: Jeffrey M Nicholson, Franklin, MA (US)

( * ) Notice: Subject to any disclaimer, the term of this patent is extended or adjusted under 35 U.S.C. 154(b) by 134 days.

This patent is subject to a terminal disclaimer.

(21) Appl. No.: 14/709,472

(22) Filed: May 11, 2015

(65) Prior Publication Data

US 2017/0055704 A1 Mar. 2, 2017

(51) Int. Cl.

| | |
|---|---|
| ***A47B 81/00*** | (2006.01) |
| ***A47B 96/06*** | (2006.01) |
| ***A47B 88/407*** | (2017.01) |
| *A47B 77/04* | (2006.01) |

(52) U.S. Cl.
CPC ..... *A47B 96/06* (2013.01); *A47B 88/407* (2017.01); *A47B 77/04* (2013.01)

(58) Field of Classification Search
CPC ..... A47B 77/16; A47B 77/02; A47B 88/0407; A47B 2088/0011; A47B 96/06
USPC ..... 312/234
See application file for complete search history.

(56) References Cited

U.S. PATENT DOCUMENTS

| | | | | |
|---|---|---|---|---|
| 2,420,173 | A * | 5/1947 | Hall | F25D 25/02 126/337 R |
| 5,312,180 | A * | 5/1994 | Tieder | A47B 88/90 220/534 |
| 6,655,538 | B2 * | 12/2003 | Saulnier-Matteini | A47B 45/00 211/105.1 |
| 9,028,017 | B2 * | 5/2015 | Nicholson | A47B 47/0066 312/304 |

* cited by examiner

*Primary Examiner* — Stanton L Krycinski
*Assistant Examiner* — Timothy M Ayres
(74) *Attorney, Agent, or Firm* — Todd L. Juneau; Juneau & Mitchell

(57) ABSTRACT

Systems, methods and apparatus are provided through which in some implementations an expandable or adjustable snap-in cam or other friction device having a mechanically lockable drawer, shelf or divider in a cabinet, pantry, kitchen cupboard mount includes no screws or other permanent mounting.

15 Claims, 25 Drawing Sheets

UNLOCKED
CONFIGURATION

LOCKED
CONFIGURATION

UNLOCKED
CONFIGURATION

LOCKED
CONFIGURATION

UNLOCKED
CONFIGURATION

LOCKED
CONFIGURATION

UNLOCKED CONFIGURATION

LOCKED CONFIGURATION

LOCKED CONFIGURATION

CHILD-PROOF LOCKABLE DRAWER

SPICE DRAWER

CRISPER DRAWER

WRAP DRAWER

NO-CONTAINER SHELF

PRESSURE MOUNTED STORAGE APPARATUS

RELATED APPLICATION

This application claims priority to U.S. Ser. No. 13/661,085 filed 26 Oct. 2012, now U.S. Pat. No. 9,028,017 issued 12 May 2015, which claims priority benefit to U.S. Provisional Application Ser. No. 61/555,074 filed 3 Nov. 2011.

FIELD

The field of the invention is a pressure mounted storage system with a locking friction clamp and a sliding container.

BRIEF DESCRIPTION

A pressure mounted storage system (PMSS) is a kitchen space optimization solution that reclaims unused storage space, reduces clutter, and delivers high-end functionality—without tools—at fraction of the price of existing systems. The PMSS is particularly beneficial in households that desire more kitchen storage space and improved organization, in contrast to professional kitchen remodeling which is expensive, and do-it-yourself (DIY) home improvement kits which are messy, time-consuming and require specific expertise, without nailing, screwing, drilling or expensive contractors—making kitchen upgrading a snap. The pressure mounting provides a friction mounting or a friction and pressure mounting of a storage apparatus to the inside of an existing kitchen cabinet or other enclosure. The drawer is one example of a shelf or other form of storage.

In one aspect, a pressure mounting apparatus comprises a platform and a locking friction clamp having at least two snap arms that are pivotally coupled at first ends to each other through a push/pivot buckle and each of the at least two snap arms being pivotally attached at second ends to a snap compression pad, wherein the plurality of snap arms have a locked position and an unlocked position wherein the locking friction clamp being mounted on the platform.

In a further aspect, an enclosure comprises a plurality of walls comprising an exterior of the enclosure, the plurality of walls forming an interior of the enclosure, a platform attached to the interior of the walls and having faces comprising a side, a front and a rear, and a plurality of locking bars protruding from at least one of the faces of the platform, wherein the plurality of locking bars have a locked position and an unlocked position wherein the plurality of locking bars being pivotally mounted on the platform, and wherein the locking bars create friction in the locked position against the plurality walls to hold the platform in place.

In another aspect, an enclosure comprises a platform, a plurality of walls coupled to the platform and at least one pivoting lever member that is mounted on the platform and operable to pivot into a position that creates force and friction against the walls.

Pressure mounting apparatuses of varying scope are described herein. In addition to the aspects and advantages described in this summary, further aspects and advantages will become apparent by reference to the drawings and by reading the detailed description that follows.

100 of a pressure mounted storage system in an unlocked configuration, according to an implementation.

Figure 3:
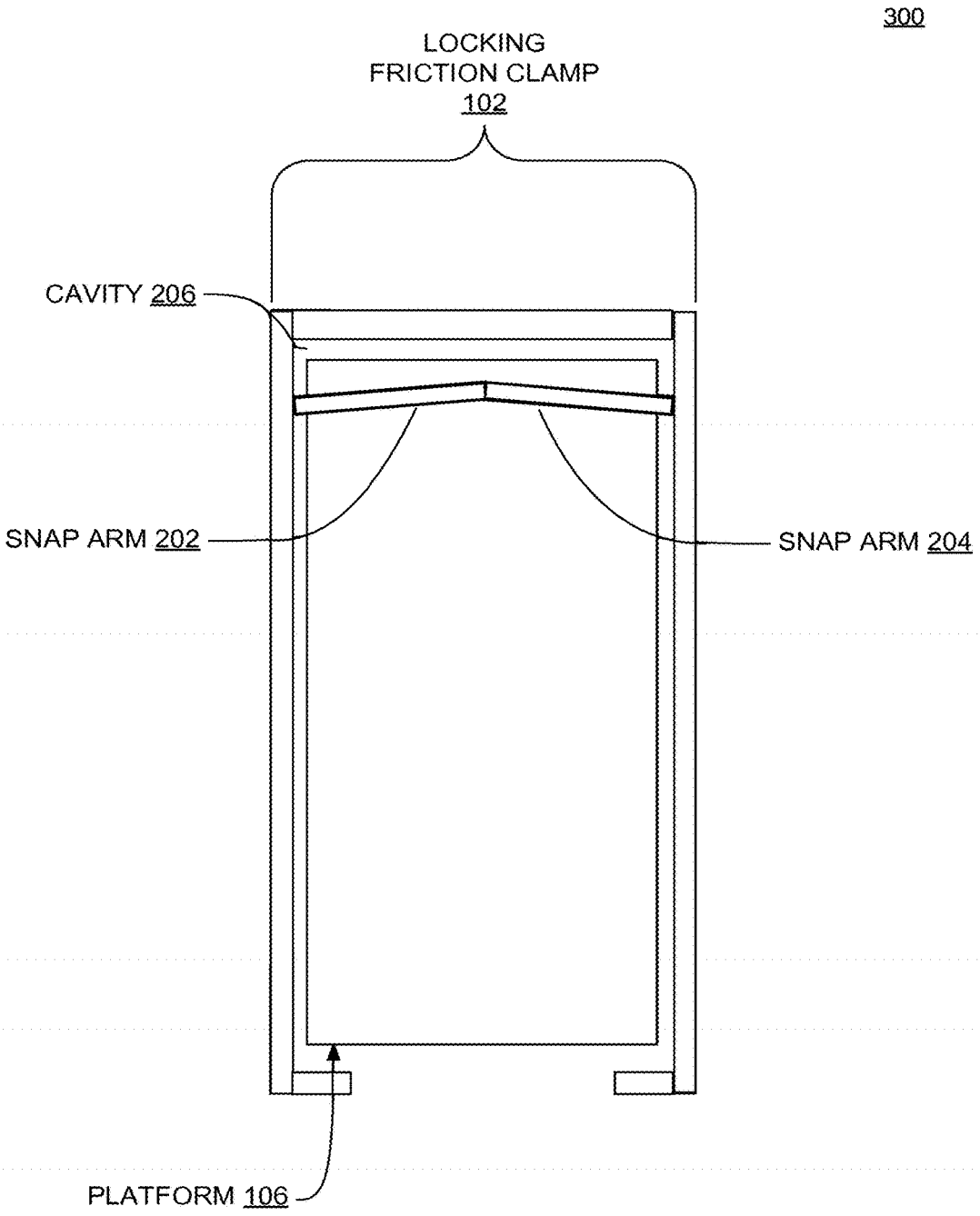

FIG. 3 is a bottom view of a block diagram of a pressure mounted apparatus of a pressure mounted storage system in a locked configuration, according to an implementation.

Figure 4:
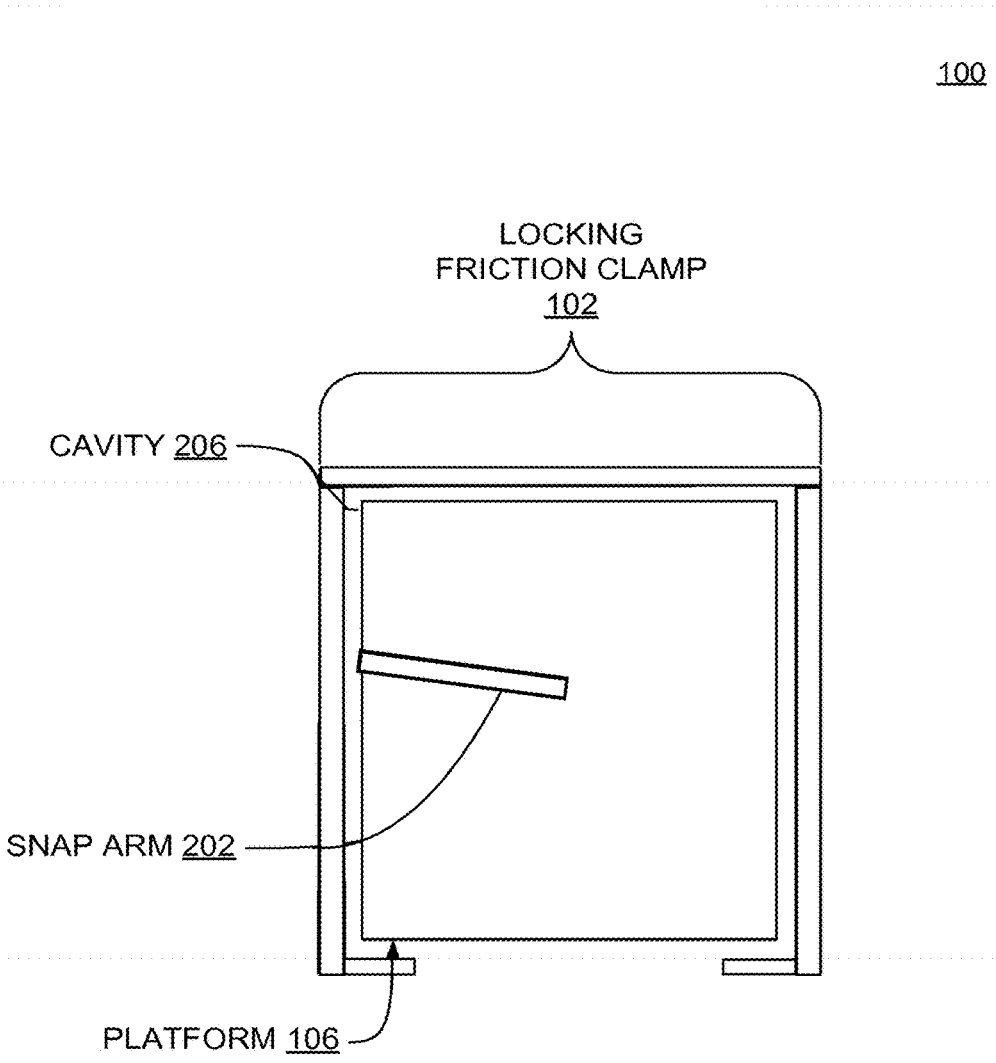

FIG. 4 is a bottom view of a block diagram of a pressure mounted apparatus of a pressure mounted storage system in an unlocked configuration, according to an implementation.

Figure 5:
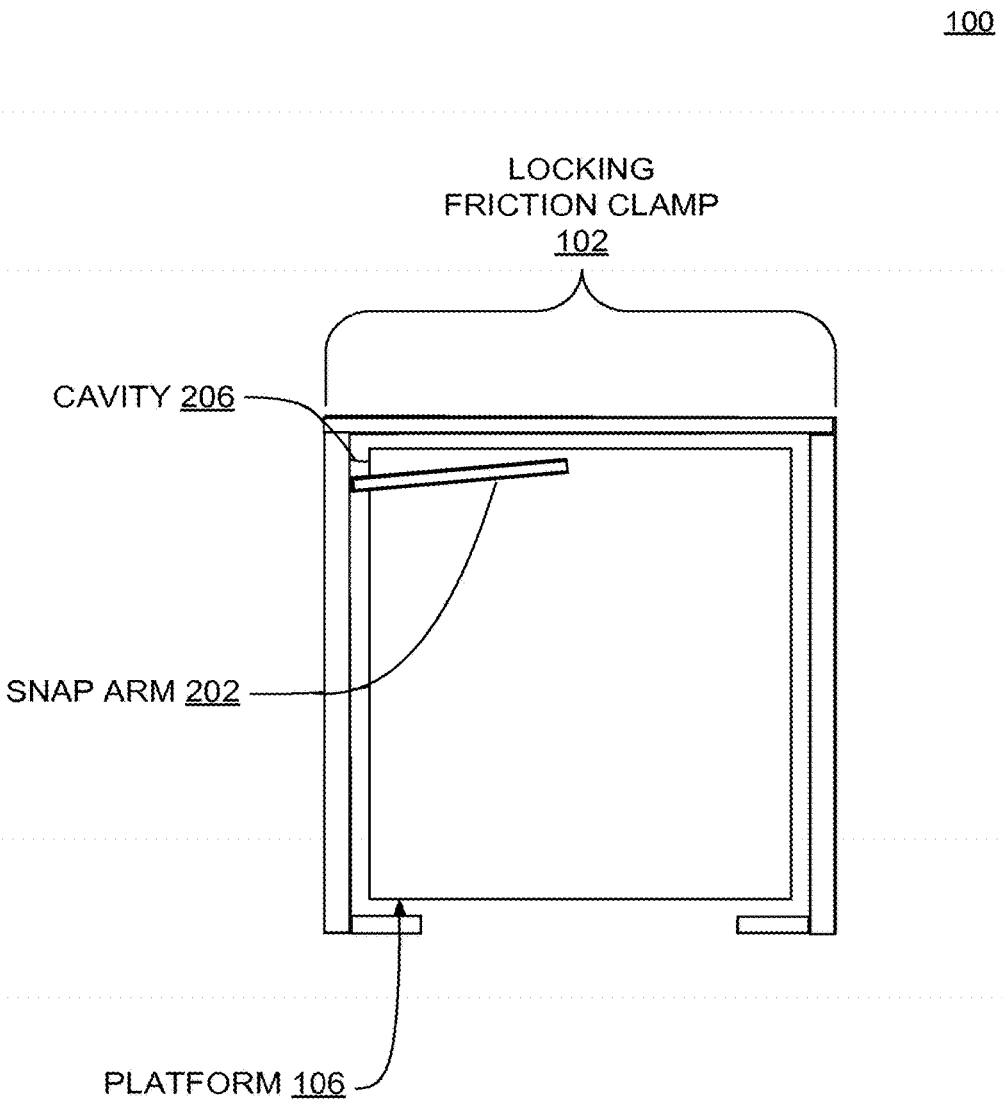

FIG. 5 is a bottom view of a block diagram of a pressure mounted apparatus of a pressure mounted storage system in an unlocked configuration, according to an implementation.

Figure 6:
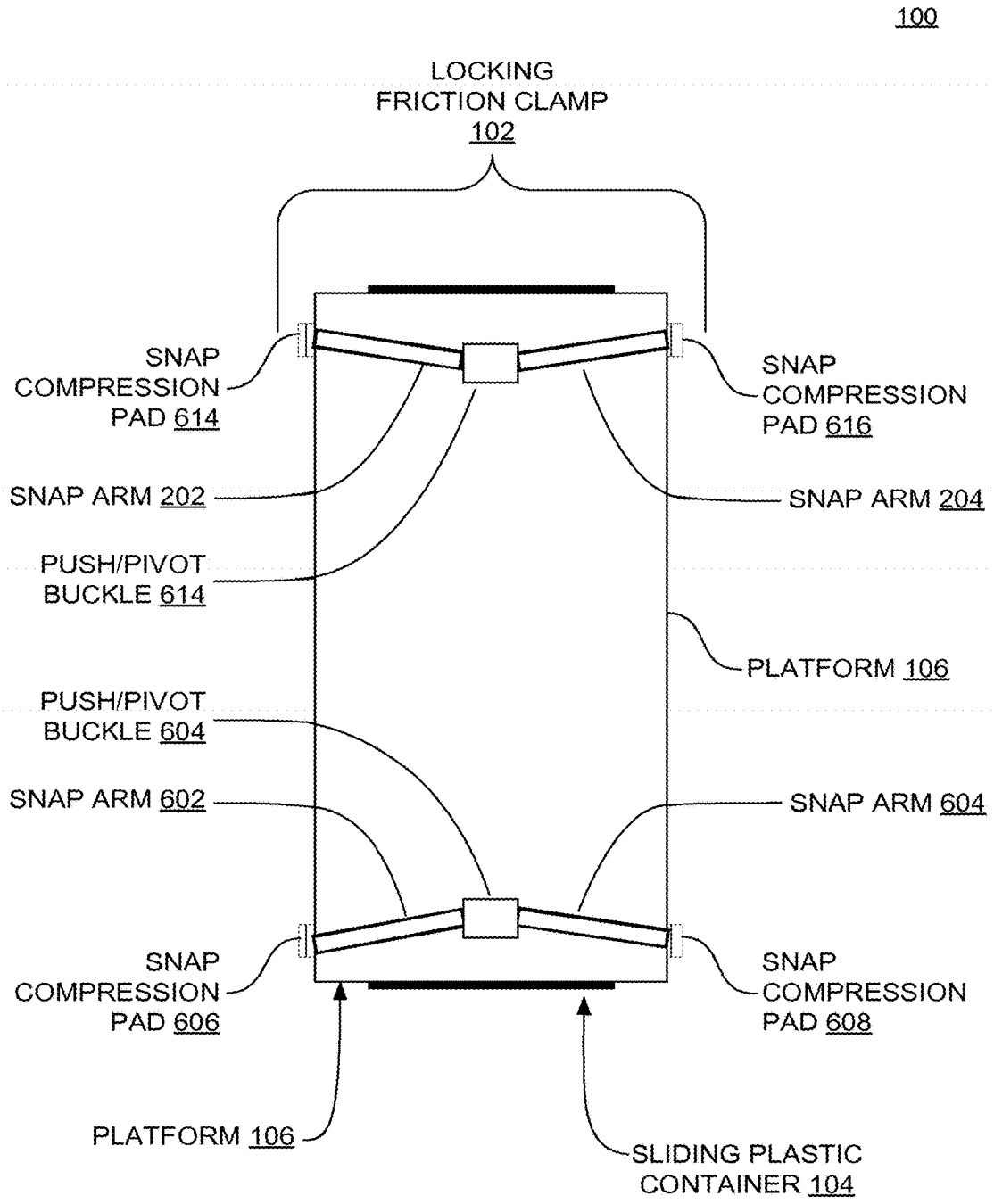

FIG. 6 is a bottom view of a block diagram of a pressure mounted storage apparatus of a pressure mounted storage system in an unlocked configuration, according to an implementation.

Figure 7:
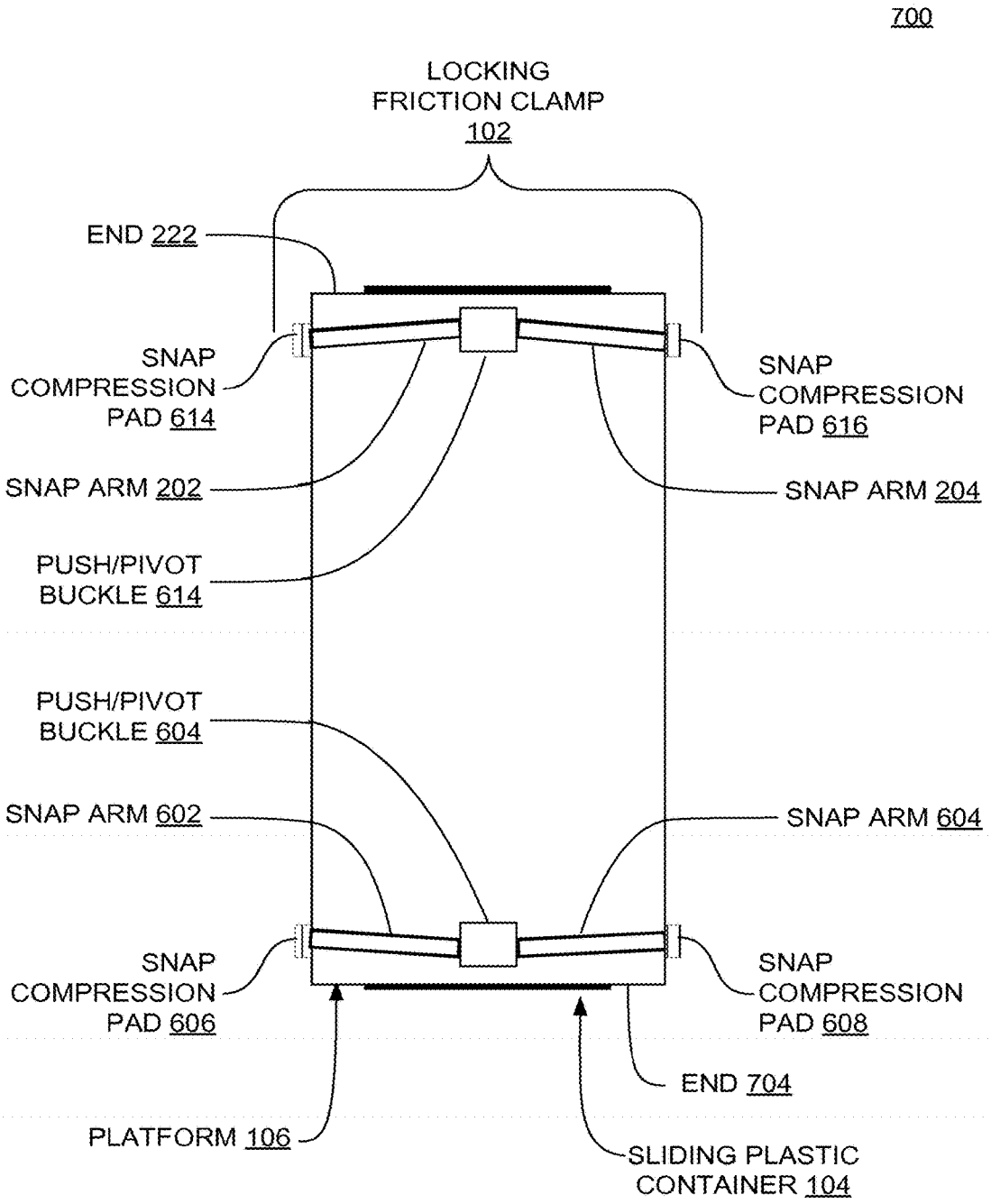

FIG. 7 is a bottom view of a block diagram of a pressure mounted storage apparatus of a pressure mounted storage system in a locked configuration, according to an implementation.

Figure 8:
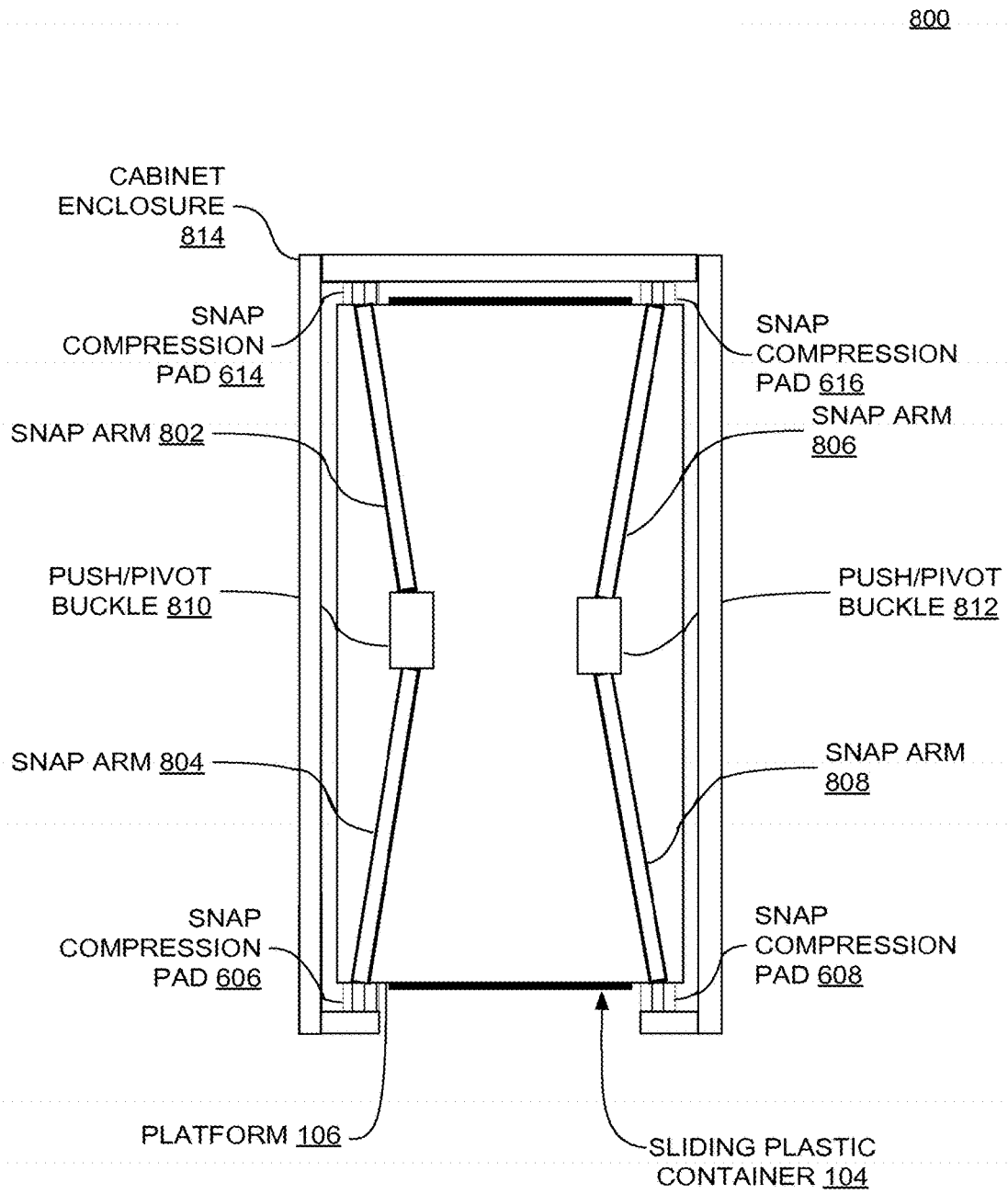

FIG. 8 is a bottom view of a block diagram of a lateral pressure mounted storage apparatus of a pressure mounted storage system in an unlocked configuration, according to an implementation.

Figure 9:
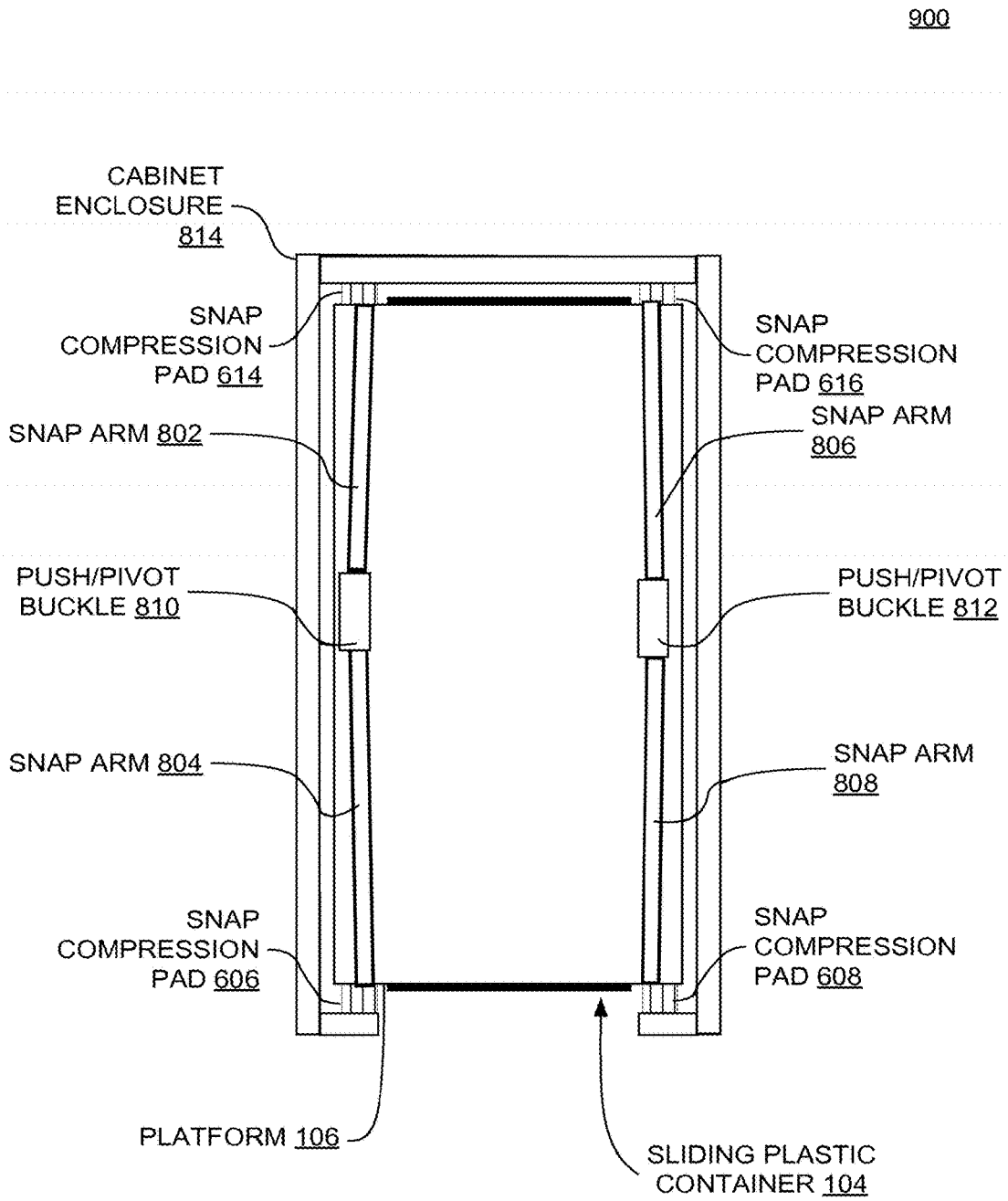

FIG. 9 is a bottom view of a block diagram of a lateral pressure mounted storage apparatus of a pressure mounted storage system in a locked configuration, according to an implementation.

Figure 10:
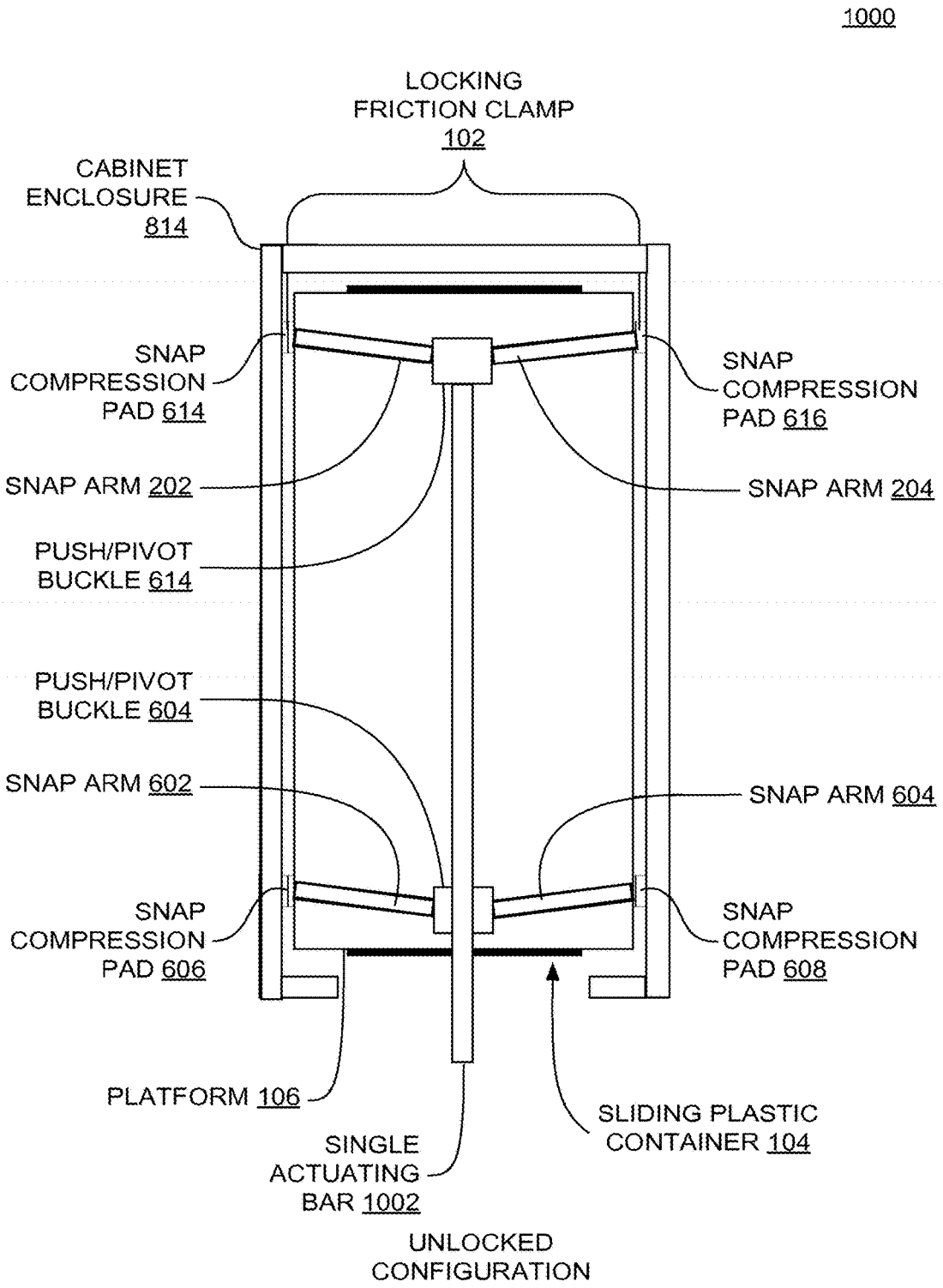

FIG. 10 is a bottom view of a block diagram of a pressure mounted storage apparatus of a pressure mounted storage system having a single actuating bar in an unlocked configuration, according to an implementation.

Figure 11:
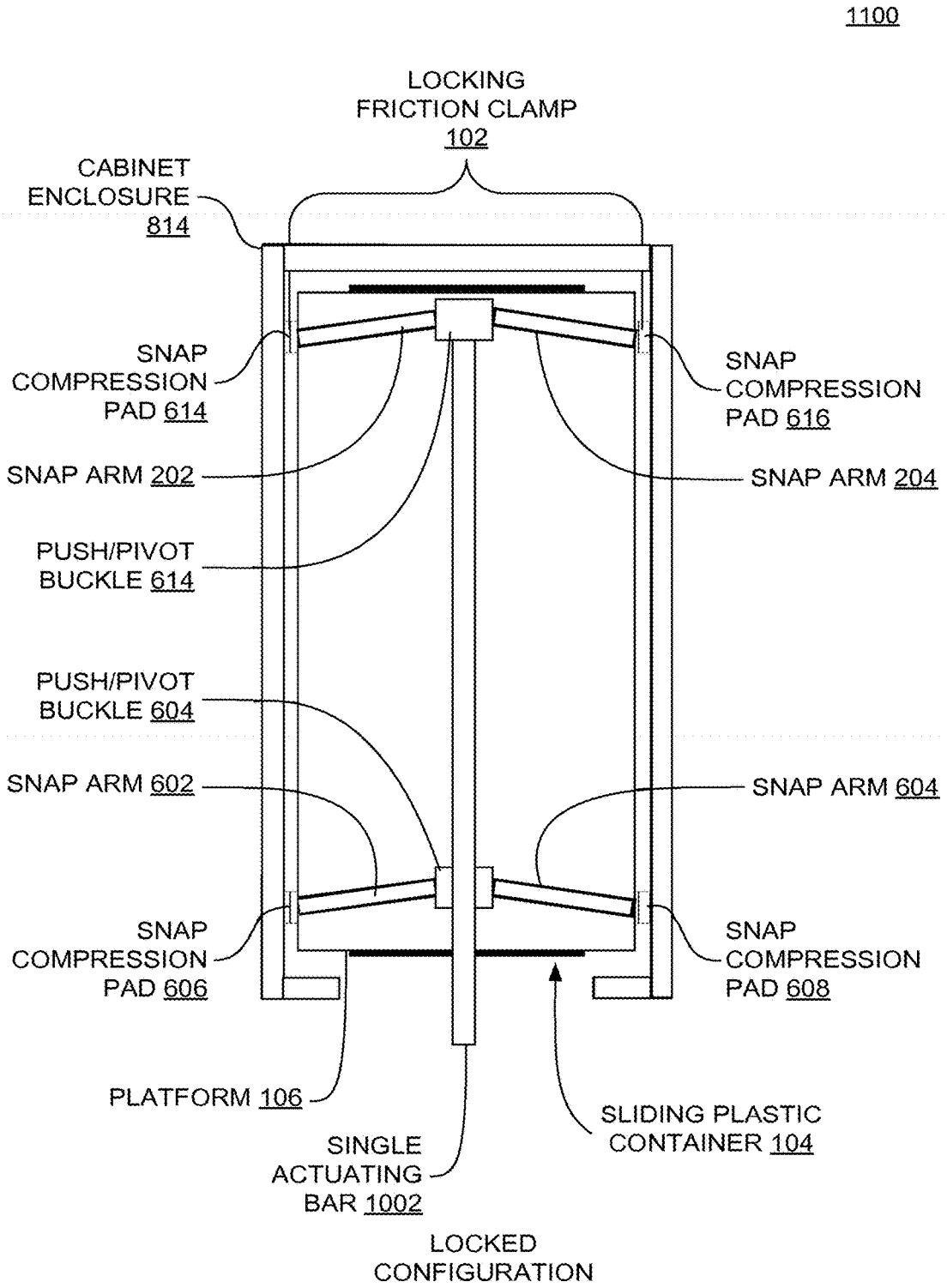

FIG. 11 is a bottom view of a block diagram of a pressure mounted storage apparatus of a pressure mounted storage system having a single actuating bar in a locked configuration, according to an implementation.

Figure 12:
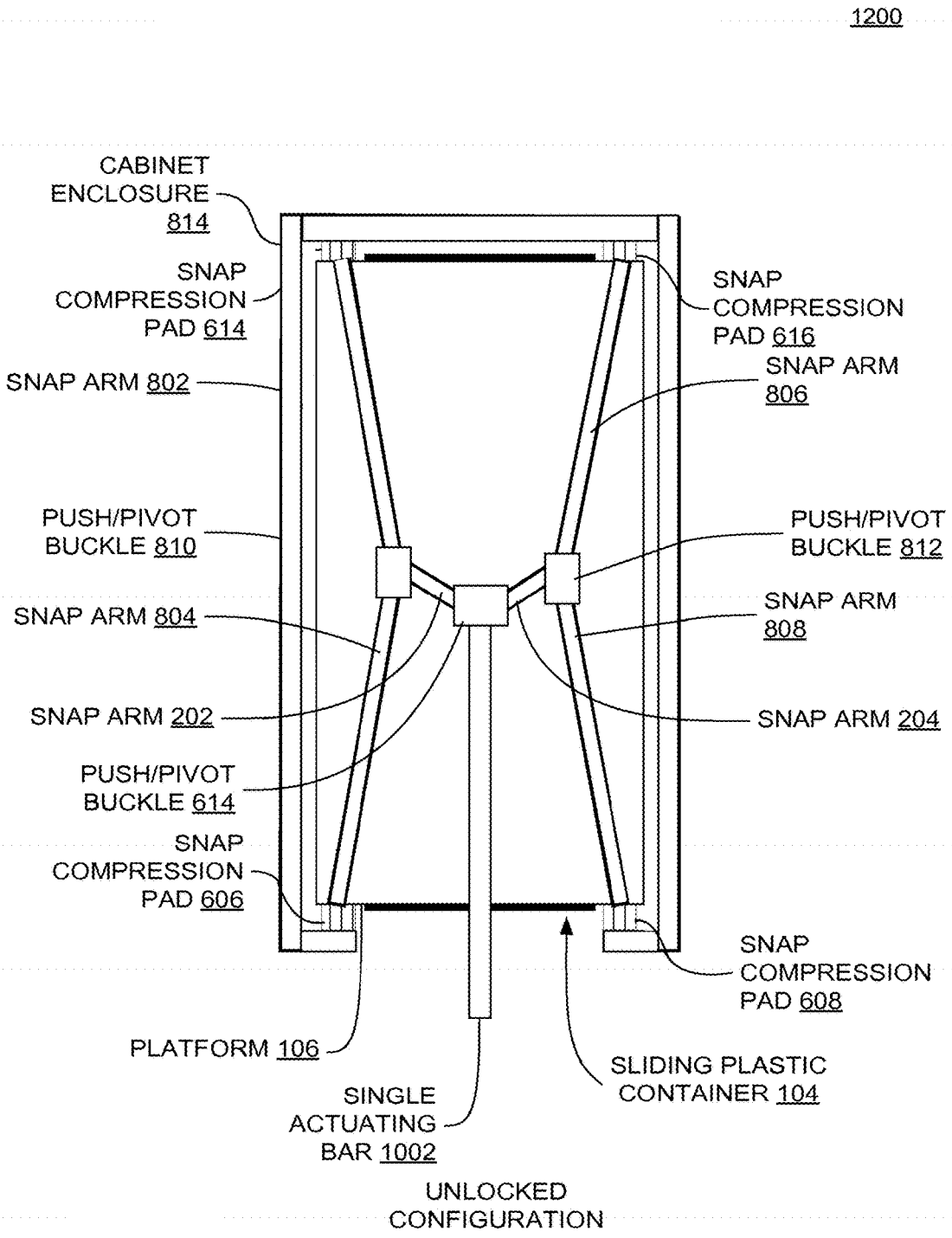

FIG. 12 is a bottom view of a block diagram of a lateral pressure mounted storage apparatus of a pressure mounted storage system in an unlocked configuration, according to an implementation.

Figure 13:
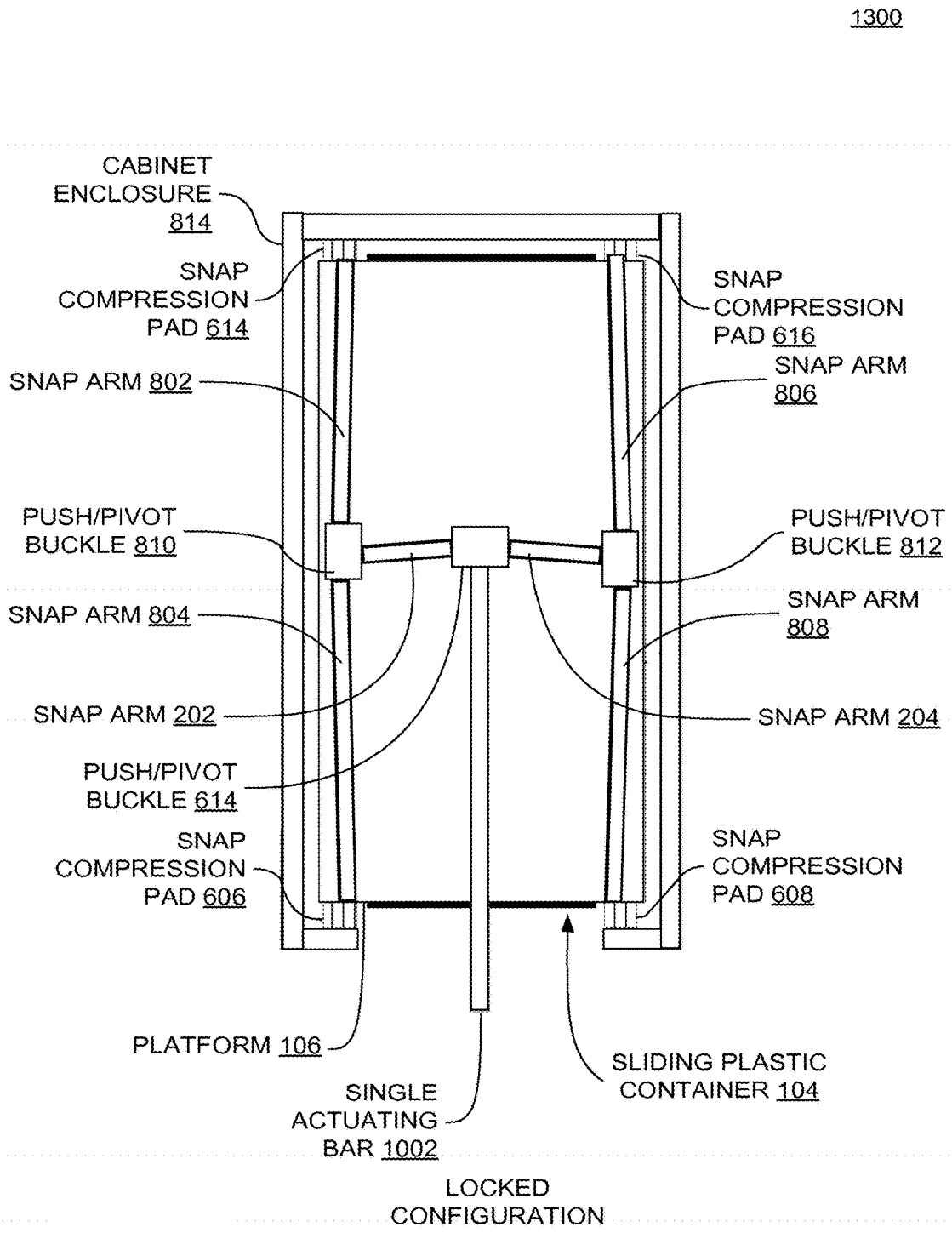

FIG. 13 is a bottom view of a block diagram of a lateral pressure mounted storage apparatus of a pressure mounted storage system in a locked configuration, according to an implementation.

Figure 14:
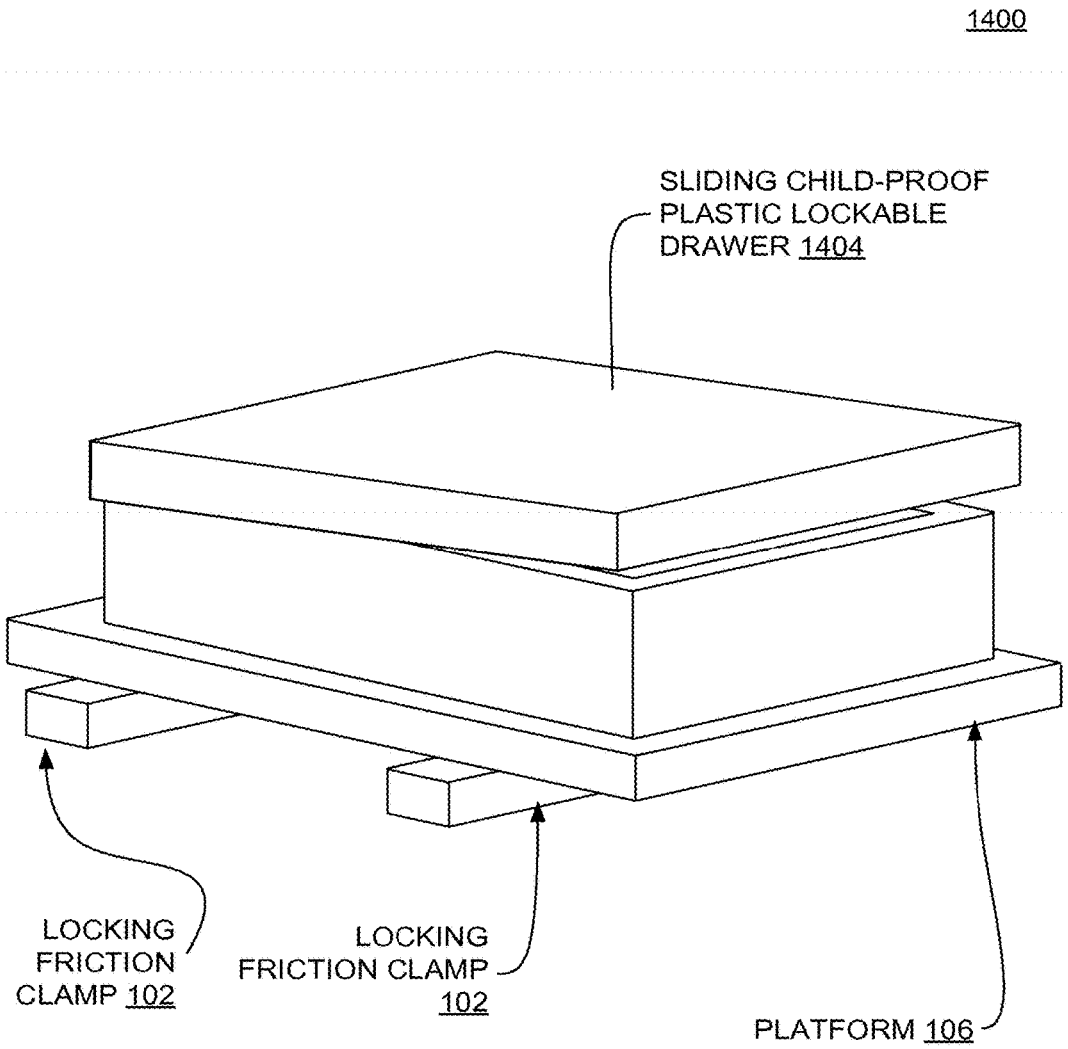

FIG. 14 is an isometric diagram of a pressure mounted child-proof lockable storage apparatus, according to an implementation.

Figure 15:
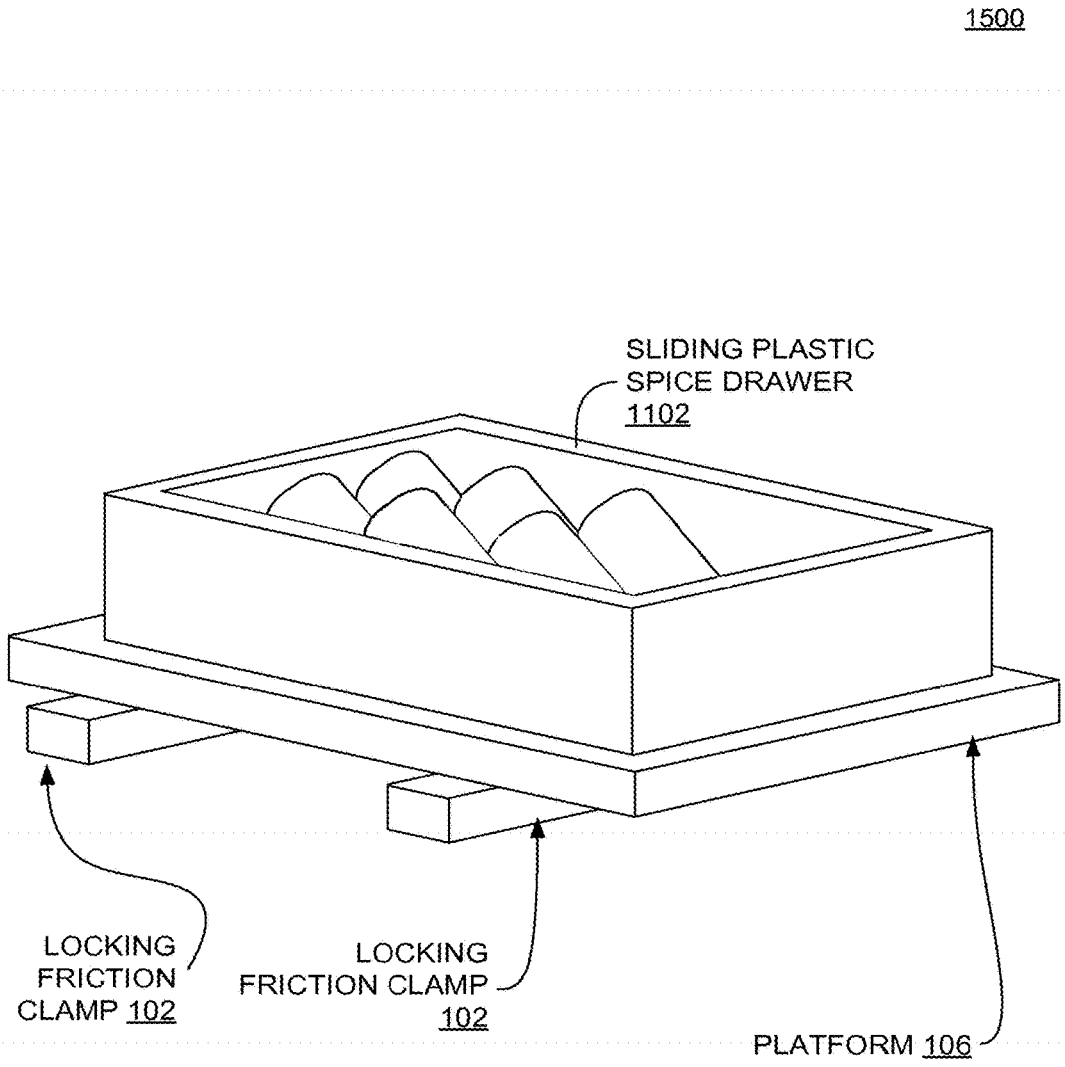

FIG. 15 is an isometric diagram of a pressure mounted spice storage apparatus, according to an implementation.

Figure 16:
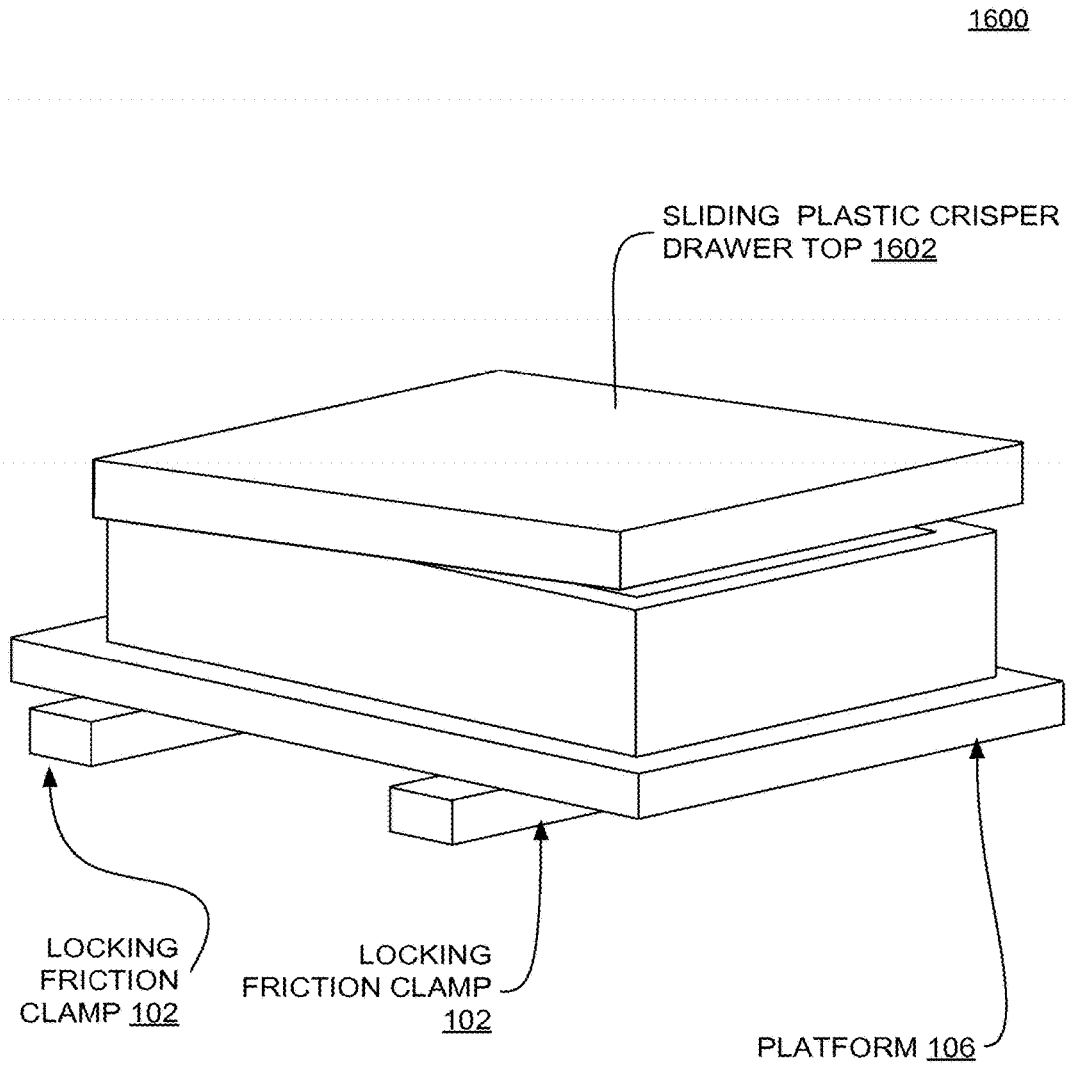

FIG. 16 is an isometric diagram of a pressure mounted crisper storage apparatus, according to an implementation.

Figure 17:
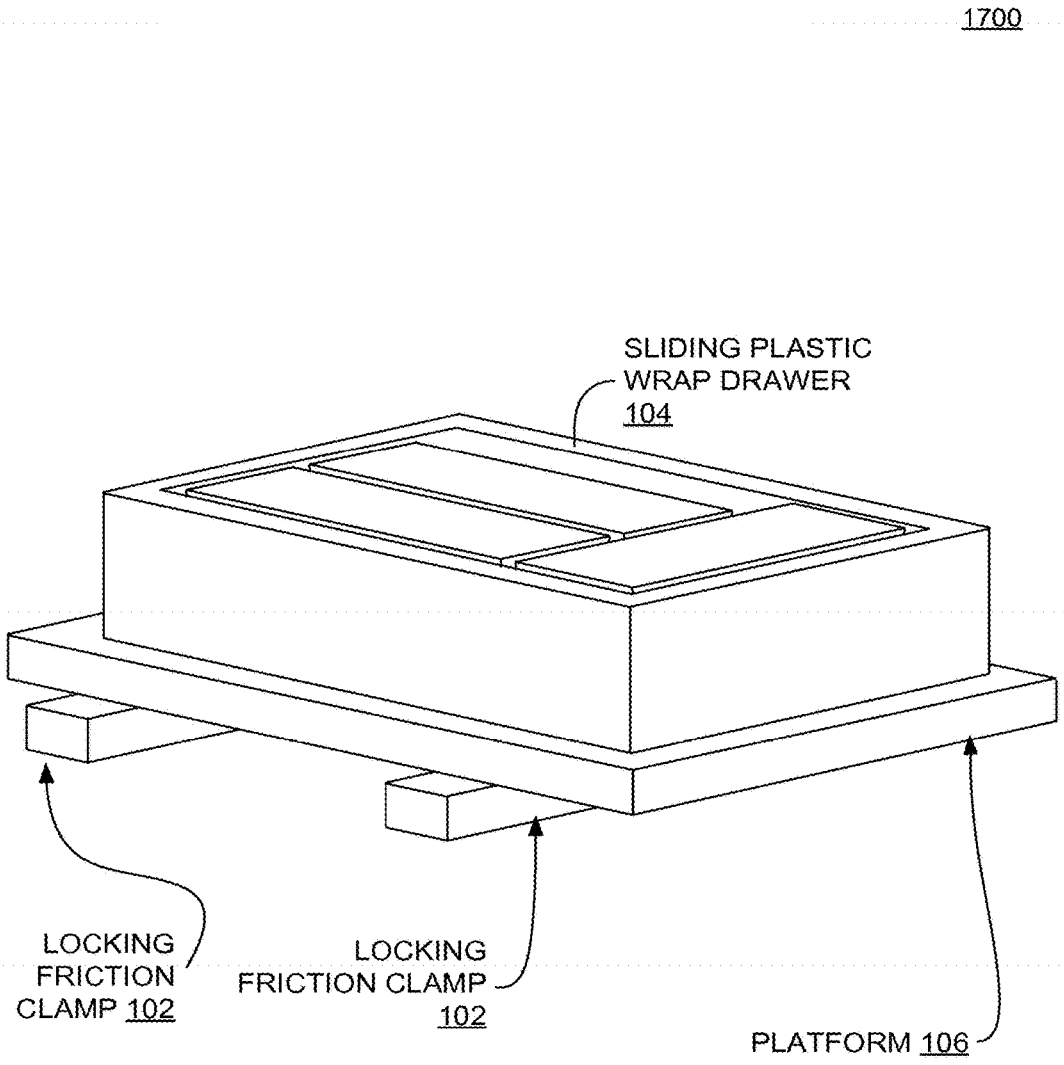

FIG. 17 is an isometric diagram of a pressure mounted wrap storage apparatus, according to an implementation.

Figure 18:
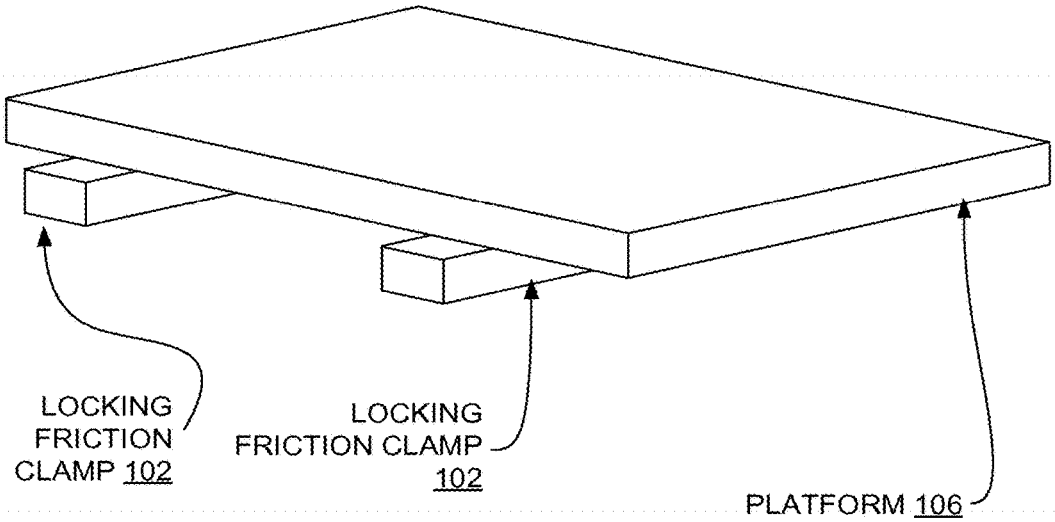

FIG. 18 is an isometric diagram of a pressure mounted platform apparatus with no drawer, according to an implementation.

Figure 19:
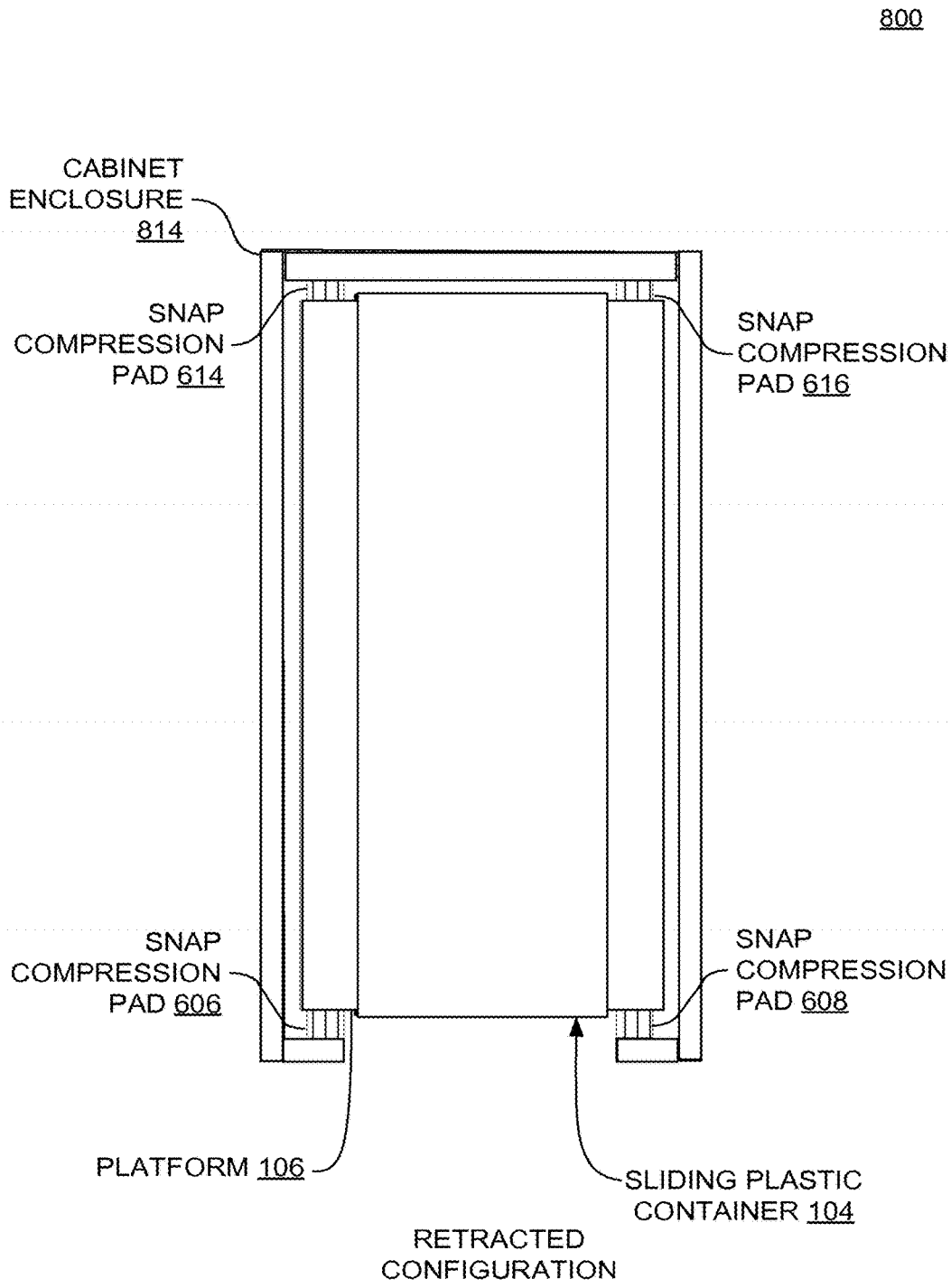

FIG. 19 is a top view of a block diagram of a lateral pressure mounted storage apparatus of a pressure mounted storage system in a closed configuration, according to an implementation.

Figure 20:
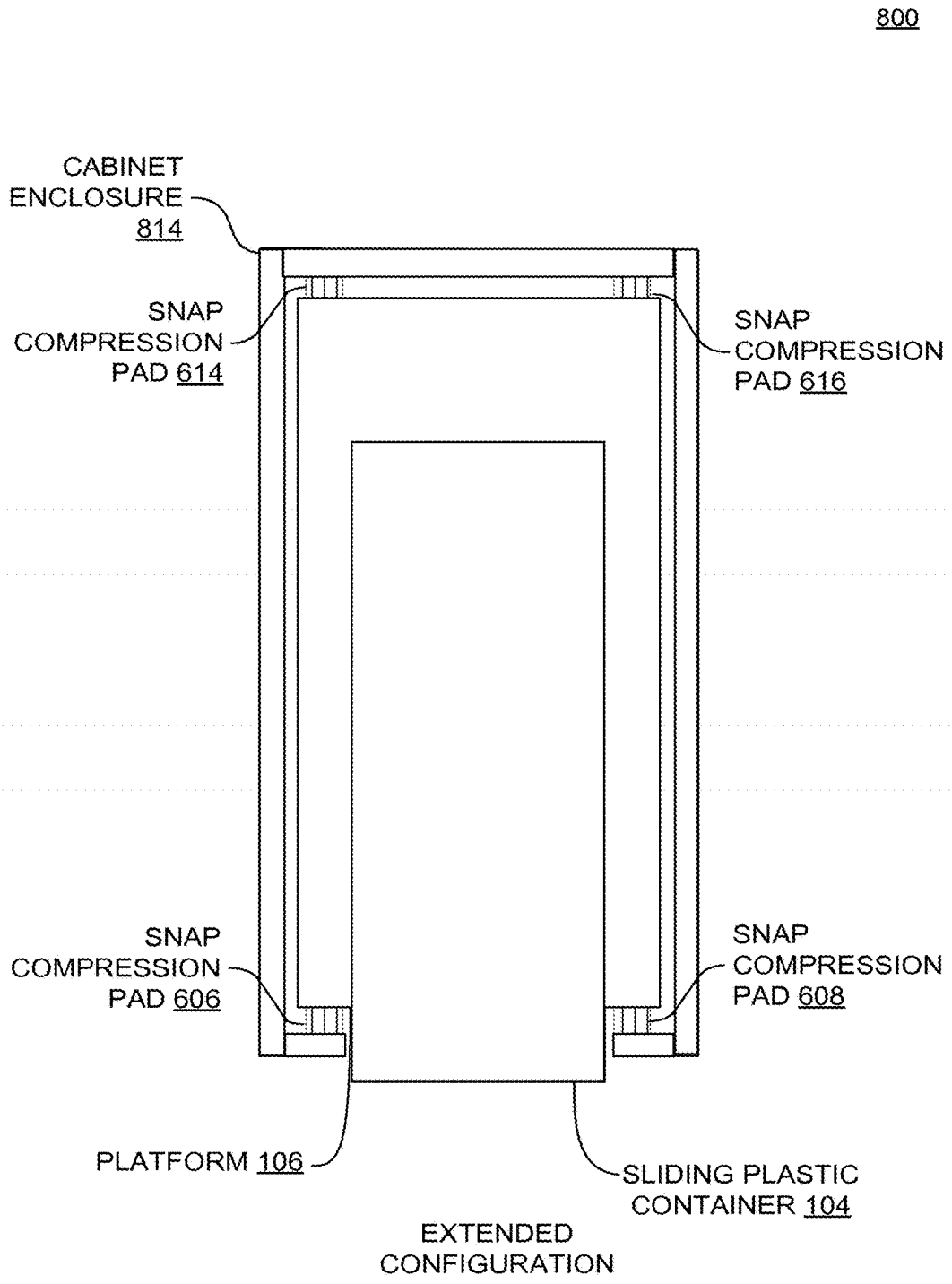

FIG. 20 is a top view of a block diagram of a lateral pressure mounted storage apparatus of a pressure mounted storage system in an open configuration, according to an implementation.

Figure 21:
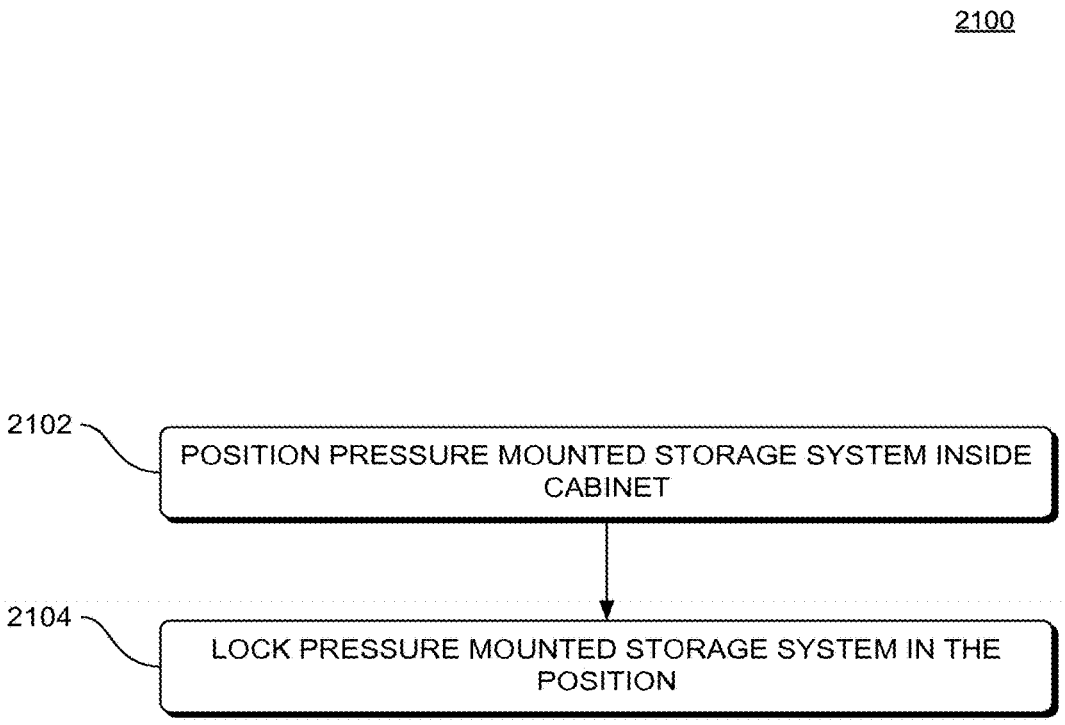

FIG. 21 is a flowchart of a method of installing the pressure mounted storage apparatus, according to an implementation.

Figure 22:
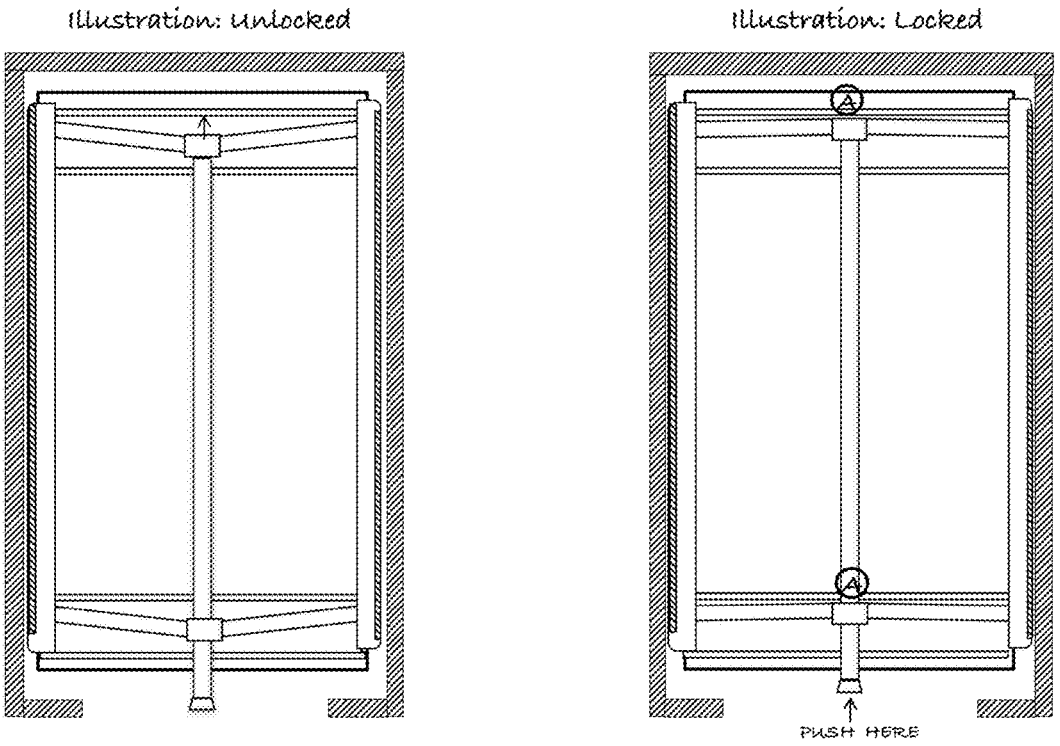

FIG. 22 shows a front to implementation of the present invention.

Figure 23:
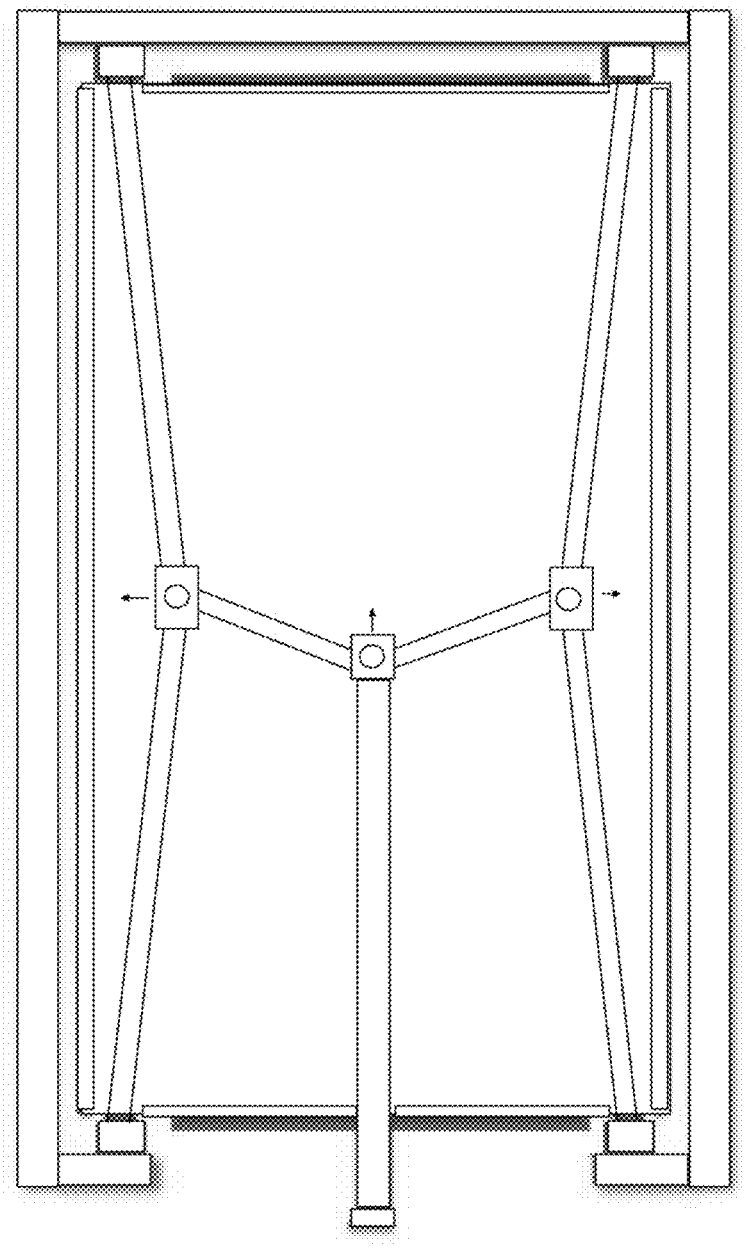

FIG. 23 shows an alternate implementation of the present invention.

Figure 24:
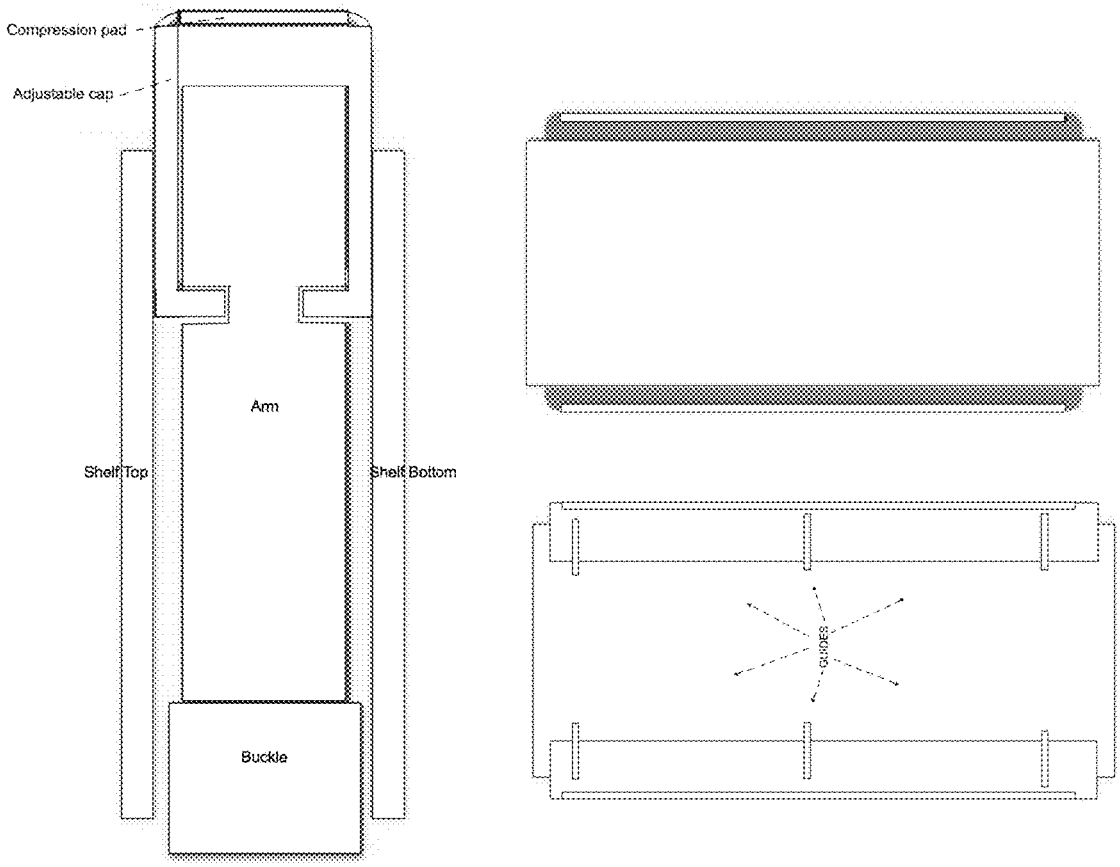

FIG. 24 show another implementation of the present invention.

DETAILED DESCRIPTION

In the following detailed description, reference is made to the accompanying drawings that form a part hereof, and in which is shown by way of illustration specific implementations that may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

The detailed description is divided into three sections. In the first section, apparatus described. In the second section, a method is described. In the third section, a conclusion of the detailed description is provided.

Apparatus

Figure 1:
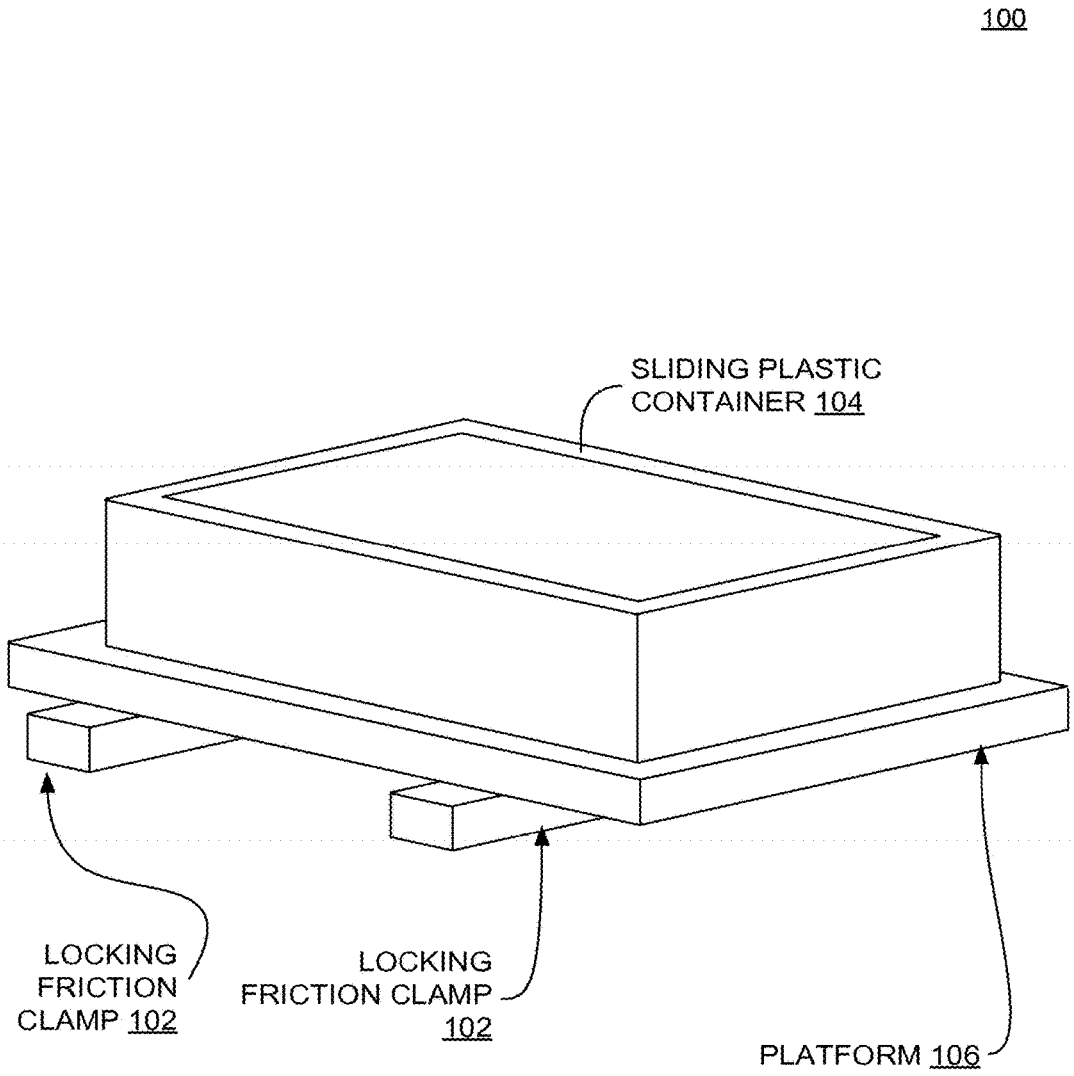
FIG. 1 is an isometric diagram of a pressure mounted storage apparatus, according to an implementation.

FIG. 1 is an isometric diagram of a pressure mounted storage apparatus 100, according to an implementation. Apparatus 100 includes two notable features and attributes: a locking friction clamp 102 and a sliding container 104. The sliding container 104 is moveably mounted or moveably attached to the locking friction clamp 102 through a platform 106. In the example shown in FIG. 1-9 the sliding plastic container 104 is a sliding drawer, but in other examples shown in FIG. 14-13, the sliding plastic container 104 is a lockable "child-proof" lockable drawer, a spice drawer, a crisper drawer, or a wrap drawer. In some implementations of the sliding drawer shown in FIG. 1, the sliding drawer is collapsible container. Some implementations of the pressure mounted storage system include a level that is integrated into the apparatus that can be used during installation to determine if the pressure mounted storage system is positioned level along an axis.

One particular benefit of pressure mounted storage apparatus 100 is that the pressure mounted storage apparatus 100 is not attached to the inside of a cabinet enclosure with screws, nails, tape, adhesive, or any other common attachment device. Instead, the pressure mounted storage apparatus 100 is simply "snapped" into place using an integrated clamp system of the locking friction clamp 102 (shown in FIG. 1-9). The integrated clamp system places outward pressure against opposing inside wall(s) of the cabinet, securely holding pressure mounted storage apparatus 100 in place within and inside the cabinet.

All cabinets in North America have standard sizes. Standard base kitchen cabinet sizes uniform in terms of depth and height (24" deep, 34½" tall). The widths are also predictable and standardized, with stock cabinets available in 3" increments (9", 12", 15", etc., usually up to 36"). The dimension makes ordering the right size no different than specifying a preferred size of shirt. Thus, the pressure mounted storage apparatus 100 is also manufactured in predictable and standardized dimensions, well-suited for mass production.

In some implementations, the sliding plastic container 104 includes an integrated pull stop (not shown in FIG. 1) so that the sliding plastic container 104 may not be completely pulled out of its housing (not shown in FIG. 1).

Figure 1B:
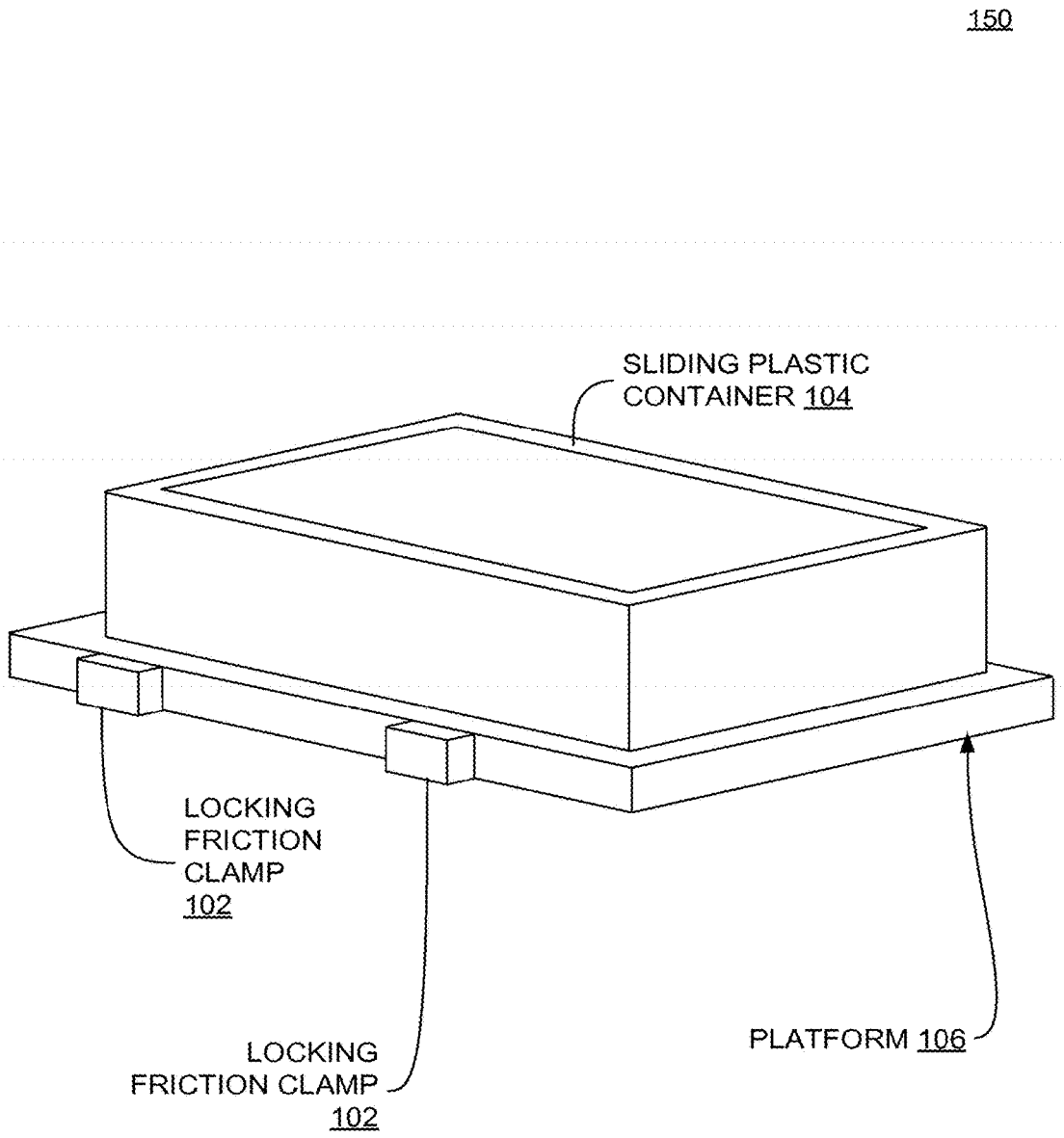
FIG. 1B is an isometric diagram of a locking friction clamp integrated into a platform of a pressure mounted storage apparatus, according to an implementation.

FIG. 1B is an isometric diagram of a locking friction clamp integrated into a platform of a pressure mounted storage apparatus 150, according to an implementation; Apparatus 150 includes two notable features and attributes: the locking friction clamp 102 is integrated into the platform 106 and the sliding container 104. The sliding container 104 is slideably mounted or slideably attached to the locking friction clamp 102 through the platform 106.

Figure 2:
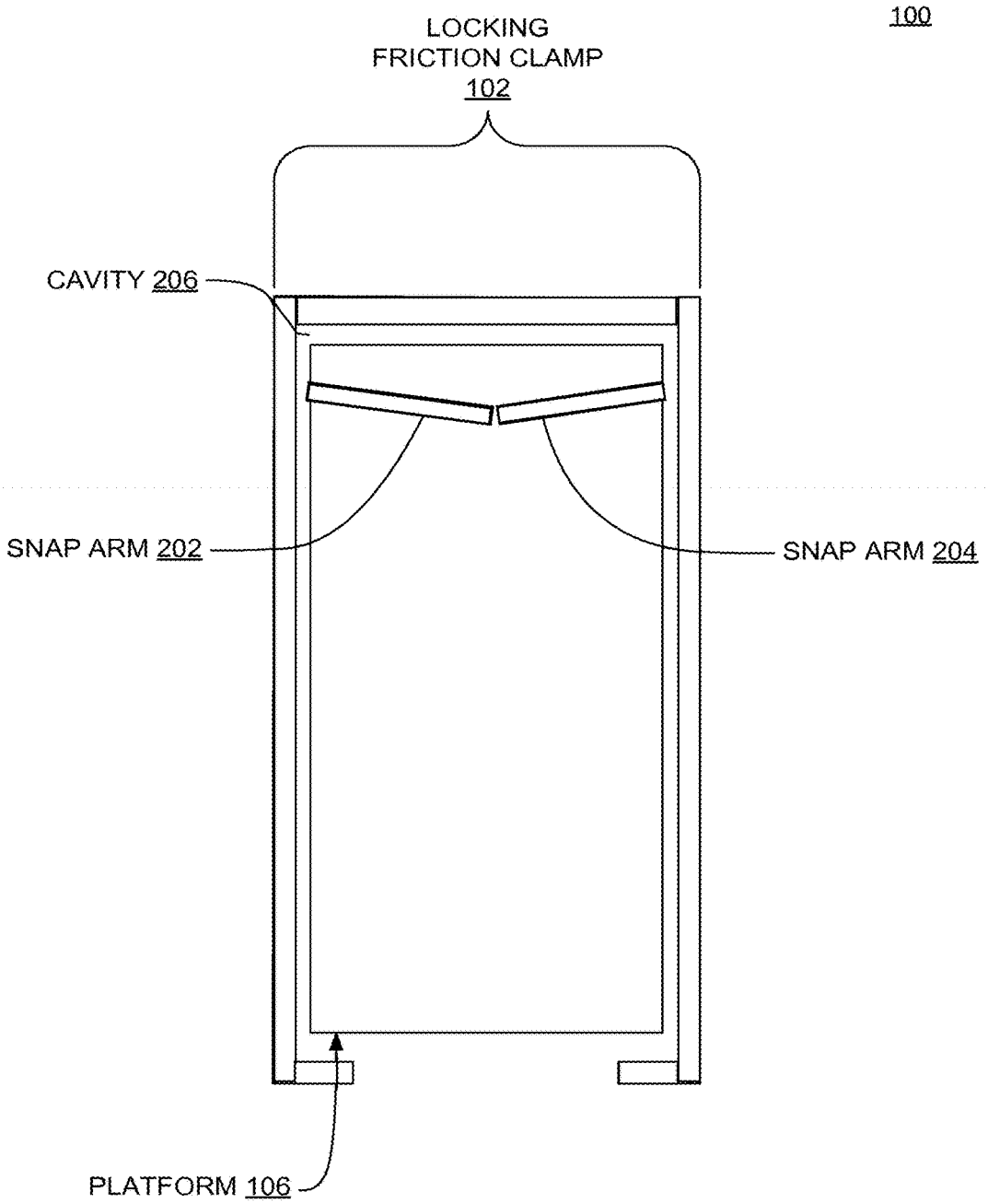
FIG. 2 is a bottom view of a block diagram of a pressure mounted apparatus.

FIG. 2 is a bottom view of a block diagram of a pressure mounted apparatus 100 of a pressure mounted storage system in an unlocked configuration, according to an implementation. The pressure mounted apparatus 100 includes a platform 106 and a locking friction clamp 102. The locking friction clamp 102 includes at least one snap arm 202 that is pivotally coupled to at least one of the platform 106 (as shown in FIG. 4-5 and at least one other snap arm 204. The at least one snap arm 202 has an unlocked (and an unlocked position as shown in FIG. 3). The at least one snap arm 202 is operable to hold the platform 106 in position in a cavity 206 by creating friction against at least on side of the cavity in the locked position, as shown in FIG. 3. In some implementations of the snap arm, the snap arm is extendable or adjustable in reach. In one example of the extendable or adjustable snap arm, the snap arm 202 is adjustable through screws, where some portion of the snap arm 202 is threaded onto a base of the snap arm 202 or onto a lead screw and threading out the screw makes the snap arm 202 longer. In another example of the extendable or adjustable snap arm, the snap arm 202 is adjustable through discrete position adjustment, wherein the snap arms 202 are snapped into different positions using a spring loaded ball or pin and holes in a sliding outer member.

In some implementations, the platform 106 is adjustable or extendable in width, such as by a sleeve that is a part of platform 106, and by a center piece that fits inside the sleeve and slides out to extend the width of the platform 106. In some implementations, the adjustable or extendable platform 106 does not lock into a given width because the platform 106 takes only vertical loads. The locking friction clamp 102 is attached to the bottom of the adjustable or/extendable platform 106 and the snap arm(s) 202 are adjustable in length, but the locking friction clamp 102 is fixed in width and has a width that is not adjustable or extendable.

FIG. 3 is a bottom view of a block diagram of a pressure mounted apparatus 100 of a pressure mounted storage system in a locked configuration, according to an implementation. The at least one snap arm 202 is in a locked position as shown in FIG. 3. The at least one snap arm 202 holds the platform 106 in a position in a cavity 206 by creating friction against at least on side of the cavity in the locked position FIG. 4 is a bottom view of a block diagram of a pressure mounted apparatus 100 of a pressure mounted storage system in an unlocked configuration, according to an implementation. The pressure mounted apparatus 100 includes a platform 106 and a locking friction clamp 102. The locking friction clamp 102 includes at least one snap arm 202 that is pivotally coupled to at least one of the platform 106 (as shown in FIG. 4-5. The at least one snap arm 202 has an unlocked (and an unlocked position as shown in FIG. 5). The at least one snap arm 202 is operable to hold the platform 106 in position in a cavity 206 by creating friction against at least one side of the cavity in the locked position, as shown in FIG. 5.

FIG. 5 is a bottom view of a block diagram of a pressure mounted apparatus 100 of a pressure mounted storage system in a locked configuration, according to an implementation. The pressure mounted apparatus 100 includes a platform 106 and a locking friction clamp 102. The locking friction clamp 102 includes at least one snap arm 202 that is pivotally coupled to at least one of the platform 106. The at least one snap arm 202 is a locked position as shown in FIG. 5. The at least one snap arm 202 is operable to hold the platform 106 in position in a cavity 206 by creating friction against at least one side of the cavity in the locked position.

FIG. 6 is a bottom view of a block diagram of a pressure mounted storage apparatus 100 of a pressure mounted storage system in an unlocked configuration, according to an implementation. The pressure mounted storage apparatus 100 is shown in FIG. 6 in an unlocked configuration.

Each locking friction clamp 102 includes at least 2 snap arms (such as 202 and 204; or 602 and 604) that are rigid arms. When the snap arms are pushed outward by a push/pivot buckle 210 and 604, the snap arms apply pressure through snap compression pads 614, 616, 606 and 608 upon and onto the inner walls of the cabinet enclosure 814. Each pair of snap arms (such as pair 202 and 204) are identical in structure and function. The push/pivot buckles 610 and 604 rotatably connect the snap arms together and serve as the central connection and rotation point to the snap arms. The snap compression pads 614, 616, 606 and 608 are attached at the end of each snap arm to ensure snug and lasting fit.

Unlike conventional approaches which require tools and precision measurement, the pressure mounted storage apparatus 100 takes advantage of the rigidity and predictability of the size and space of standard kitchen cabinets in which the dimensions of the pressure mounted storage apparatus 100 is reasonably calculated to have a tight snug fit in a specifically sized cabinet when the snaps arms 202, 204, 602 and 604 are locked (such as in FIG. 7) yet the pressure mounted storage apparatus 100 is reasonably calculated to have a loose fit in the same specifically sized cabinet when the snaps arms 202, 204, 602 and 604 are unlocked (such as in FIG. 6).

The snap arms (e.g. 202, 204, 602 and 604) are also known as pivoting lever members. The snap compression pad (e.g. 614) is also known at a locking bar.

FIG. 7 is a bottom view of a block diagram of a pressure mounted storage apparatus 100 of a pressure mounted storage system in a locked configuration, according to an implementation. The pressure mounted storage apparatus 100 shown in FIG. 7 is a locked configuration.

The locking friction clamp 102 includes snap arms 202, 204, 602 and 604 that are rigid arms that when pushed outward by the push/pivot buckle 610 and 604, as shown in FIG. 7, applies pressure through snap compression pads 614, 616, 606 and 608 upon the outer walls of the cabinet enclosure 814. The snap compression pads 614, 616, 606 and 608 is attached at the end of each snap arm to ensure snug and lasting fit. Note that in the locked configuration or position as shown in FIG. 7, the snap arms 202, 204, 602 and 604 are not aligned in a straight line to each other, but have in fact been moved from the position as shown in FIG. 6 to a position further beyond straight alignment to each other to a position in which the push/pivot buckle 610 is closer to closest end 222 of the platform 106 than are the snap compression pads 614 and 616 and to a position in which the push/pivot buckle 604 is closer to closest end 702 of the platform 106 than are the snap compression pads 606 and 608. The location of the snap arms 202, 204, 602 and 604 when not aligned in a straight line to each other after having been moved from the position as shown in FIG. 6 to a position further beyond straight alignment to each other is known as "negative space" helps ensure position of the locking friction clamp 102 remains locked in place, without risk of unintentional release. The negative space is an area on one side of the snaps arms 202, 204, 602 and 604 in which the snap arms move past 90 degrees into a locked position of about 3 degrees past 90 or so.

The snap arms can be positioned either from side-to-side as shown in FIG. 6-3 or from front-to-back as shown in FIG. 8-5. In another example of the extendable or adjustable snap arm, each snap arm is adjustable through caps or compression pads 606, 608, 614 and 616 of different thicknesses can be placed on the ends of the snap arms, 202, 204, 602 and 604, respectively. In some implementations, the snap arms (e.g. 202, 204, 602 and 604) have a threaded end that allows adjustment of the length of the snap arms.

FIG. 8 is a bottom view of a block diagram of a lateral pressure mounted storage apparatus 800 of a pressure mounted storage system in an unlocked configuration, according to an implementation. The pressure mounted storage apparatus 800 is shown in FIG. 8 in an unlocked configuration.

The locking friction clamp 102 includes snap arms 802, 804, 806 and 808 that are rigid arms. When the snap arms are pushed outward by a push/pivot buckle 810 and 812, the snap arms apply pressure through snap compression pads 614, 616, 606 and 608 upon and onto the inner walls of the cabinet enclosure 814. Each pair of snap arms (such as pair 802 and 804) are identical in structure and function. The push/pivot buckles 810 and 812 connect the snap arms together and serve as the central connection and rotation point to the snap arms. The snap compression pads 614, 616, 606 and 608 are attached at the end of each snap arm to ensure snug and lasting fit. Negative space ensures position of the locking friction clamp 102 remains locked in place, without risk of unintentional release.

FIG. 9 is a bottom view of a block diagram of a lateral pressure mounted storage apparatus 800 of a pressure mounted storage system in a locked configuration, according to an implementation. The pressure mounted storage apparatus 800 shown in FIG. 9 in a locked configuration.

The locking friction clamp 102 includes snap arms 802, 804, 806 and 808 that are rigid arms that when pushed outward by the push/pivot buckle 810 and 812, as shown in FIG. 9, applies pressure through the snap compression pads 614, 616, 606 and 608 upon the outer walls of the cabinet enclosure 814. The snap compression pads 614, 616, 606 and 608 is attached at the end of each snap arm to ensure snug and lasting fit. Negative space ensures position of the locking friction clamp 102 remains locked in place, without risk of unintentional release.

FIG. 10 is a bottom view of a block diagram of a pressure mounted storage apparatus 1000 of a pressure mounted storage system having a single actuating bar in an unlocked configuration, according to an implementation. The pressure mounted storage apparatus 100 is shown in FIG. 6 in an unlocked configuration.

The single actuating bar 1002 provides a mechanism to apply mechanical pressure to all of the snap arms 202, 204, 602 and 604 simultaneously.

FIG. 11 is a bottom view of a block diagram of a pressure mounted storage apparatus 1100 of a pressure mounted storage system having a single actuating bar in a locked configuration, according to an implementation. The pressure mounted storage apparatus 100 is shown in FIG. 11 in a locked configuration.

The single actuating bar 1002 applies mechanical pressure to all of the snap arms 202, 204, 602 and 604 simultaneously. In another implementation of pressure mounted storage apparatus 1000 in FIG. 10 and pressure mounted storage apparatus 1100 in FIG. 1100, at least two actuating bars are implemented, one actuating bar positioned towards the left side of the pressure mounted storage apparatus 1000 and 1100 and a second actuating bar positioned towards the right side of the pressure mounted storage apparatus 1000 and 1100.

FIG. 12 is a bottom view of a block diagram of a lateral pressure mounted storage apparatus 1200 of a pressure mounted storage system in an unlocked configuration, according to an implementation. The pressure mounted storage apparatus 1200 is shown in FIG. 12 in an unlocked configuration.

The locking friction clamp 102 includes snap arms 202 and 204 that are rigid arms. When the snap arms 202 and 204 are pushed outward by a push/pivot buckle 610, the snap arms 202 and 204 apply pressure through snap compression pads 614, 616, 606 and 608 upon and onto snap arms 802, 804, 806 and 808 that are rigid arms. When the snap arms are pushed outward by a push/pivot buckle 810 and 812, the snap arms apply pressure through a snap compression pads 614, 616, 606 and 608 upon and onto the inner walls of the cabinet enclosure 814. Each pair of snap arms (such as pair 802 and 804) are identical in structure and function. The push/pivot buckles 810 and 812 connect the snap arms together and serve as the central connection and rotation point to the snap arms. The snap compression pads 614, 616, 606 and 608 are attached at the end of each snap arm to ensure snug and lasting fit. Negative space ensures position of the locking friction clamp 102 remains locked in place, without risk of unintentional release.

FIG. 13 is a bottom view of a block diagram of a lateral pressure mounted storage apparatus 1200 of a pressure mounted storage system in a locked configuration, according to an implementation. The pressure mounted storage apparatus 1200 is shown in FIG. 13 in a locked configuration.

The locking friction clamp 102 includes snap arms 202 and 204 that are rigid arms. When the snap arms 202 and 204 are pushed outward by a push/pivot buckle 610, the snap arms 202 and 204 apply pressure through snap compression pads 614, 616, 606 and 608 upon and onto snap arms 802, 804, 806 and 808 that are rigid arms. When the snap arms are pushed outward by a push/pivot buckle 810 and 812, the snap arms apply pressure through a snap compression pads 614, 616, 606 and 608 upon and onto the inner walls of the cabinet enclosure 814. Each pair of snap arms (such as pair 802 and 804) are identical in structure and function. The push/pivot buckles 810 and 812 connect the snap arms together and serve as the central connection and rotation point to the snap arms. The snap compression pads 614, 616, 606 and 608 are attached at the end of each snap arm to ensure snug and lasting fit. Negative space ensures position of the locking friction clamp 102 remains locked in place, without risk of unintentional release.

FIG. 14 is an isometric diagram of a pressure mounted child-prooflockable storage apparatus 1400, according to an implementation. The pressure mounted child-proof lockable storage apparatus 1400 includes a sliding child-proof lockable drawer 1402.

FIG. 15 is an isometric diagram of a pressure mounted spice storage apparatus 1500, according to an implementation. The pressure mounted spice storage apparatus 1500 includes a sliding plastic spice drawer 1502.

FIG. 16 is an isometric diagram of a pressure mounted crisper storage apparatus 1600, according to an implementation. The pressure mounted crisper storage apparatus 1600 includes a crisper drawer with a top 1602.

FIG. 17 is an isometric diagram of a pressure mounted wrap storage apparatus 1700, according to an implementation. The pressure mounted wrap storage apparatus 1700 includes a drawer that is suitable for storing packages of aluminum foil wrap and plastic wrap. Some implementations of the pressure mounted wrap storage apparatus 1700 include dividers that separate the packages of aluminum foil wrap and plastic wrap.

FIG. 18 is an isometric diagram of a pressure mounted platform apparatus 1800 with no drawer or container, according to an implementation.

FIG. 19 is a top view of a block diagram of a lateral pressure mounted storage apparatus 800 of a pressure mounted storage system in a closed configuration, according to an implementation.

The locking friction clamp 102 includes the snap compression pads 614, 616, 606 and 608 that are attached at the end of each snap arm (not shown in FIG. 19) to ensure snug and lasting fit. The sliding plastic container 104 is in a retracted (closed) position.

FIG. 20 is a top view of a block diagram of a lateral pressure mounted storage apparatus 800 of a pressure mounted storage system in an open configuration, according to an implementation. The sliding plastic container 104 is in an extended (opened) position.

Method

FIG. 21 is a flowchart of a method 2100 of installing the pressure mounted storage apparatus, according to an implementation. Method 2100 includes positioning the pressure mounted storage apparatus inside a cabinet at block 2102 and locking the pressure mounted storage apparatus in the position by snapping the snap bars in a locked position.

FIGS. 22, 23, and 24 show implementations of the invention having a front to back orientation rather than a side to side orientation. In implementations having a Vertical axis rather than a Horizontal axis, there has to be pressure at sides of the cabinet; in essence, for front to back pressure. In some cases, it may be desirable to apply pressure at front and back rather than side to side. Examples include double cabinets and bathroom base cabinets, where there are several doors but just an open inner space, without the aid of a dividing wall. In these instances, the same design and principles will be used, however the pressure will be applied simultaneously at front and rear. The same center actuating bar will be used, which then activates one center snap arm on each side, coupled by a buckle. Each of these snap arms then are connected by a buckle to a pair of secondary snap arm which will apply pressure toward each side, extending the snap arms and applying pressure at front and back. Referring now to the Full length compression pad/friction plate, instead of having the 2 "feet" on each side, each with their own friction/compression pad, in this configuration there is a sort of cap that goes over the ends of the snap arms, fitting into the full side of the unit, somewhat floating there in the pocket. This then allows the compression/friction pad to run the full length, making the result much stronger with the very same pressure. A nice benefit, this also allows for slightly thicker and thinner versions of the cap to accommodate metric/imperial sizes with fewer molds. In this configuration in FIGS. 22-24, the snap arm forming "feet" are engaged to a secondary snap cap that spans the length of the outer wall. The friction pad is not restricted to just the location feet in this configuration, but can now span the full distance of the outer edge of the unit, both increasing surface tension and more evenly distributing pressure along the full length of the wall. The snap cap, is attached on each side and actuated by the snap arms. To ensure smooth movement guides ensure proper in/out motion. In order to permit the same base shelf unit to be used with multiple cabinet sizes, the snap cap is adjustable. The snap cap has "teeth" which permit it to be moved in/out depending upon the cabinet size. This minimizes the number of parts that are required to accommodate multiple sizes of cabinets, including metric/imperial conversions.

CONCLUSION

In particular, one of skill in the art will readily appreciate that the names of the methods and apparatus are not intended to limit implementations. Furthermore, additional methods and apparatus can be added to the components, functions can be rearranged among the components, and new components to correspond to future enhancements and physical devices used in implementations can be introduced without departing from the scope of implementations. One of skill in the art will readily recognize that implementations are applicable to future drawers, different pivots, and new moveable mounts. The terminology used in this application is meant to include all pivot arms and compression pads and alternate technologies which provide the same functionality as described herein.

The invention claimed is:

1. A pressure mounting apparatus comprising:

a planar rectangular platform having a first plane that is parallel to both of the two longest dimensions of the planar platform;

a locking friction clamp arranged along a second plane parallel to the first plane, the locking friction clamp having a single actuating bar connected by a center buckle to a pair of center snap arms, the pair of center snap arms including a first center snap arm and a second center snap arm, the first center snap arm having an inner end attached to the center buckle and an outer end attached to a first outer buckle, the second center snap arm having an inner end attached to the center buckle and an outer end attached to a second outer buckle, the first outer buckle attached to each inner end of a first pair of outer snap arms, each outer end of the first pair of outer snap arms having a snap compression pad, the second outer buckle attached to each inner end of a second pair of outer snap arms, each outer end of the second pair of outer snap arms having a snap compression pad, wherein the snap arms have a locked position and an unlocked position and wherein the snap arms hold the platform in position in an enclosure having at least two opposing walls by creating friction against the opposing walls of the enclosure with the snap compression pads while in the locked position, wherein the snap compression pads are not attached to the opposing walls of the enclosure using an attachment device and in the locked position the snap arms are rotated to a position beyond a straight line alignment to each other; and the single actuating bar is movable along an axis the second plane and applies equal mechanical pressure along the second plane to each of the outer snap arms simultaneously.

2. The pressure mounting apparatus of claim 1, where said outer snap arms are identical in length.

3. The pressure mounting apparatus of claim 1, where said snap arms are rigid.

4. The pressure mounting apparatus of claim 1, wherein the mechanical pressure applied by the snap compression pads to the walls of the enclosure is in the same direction as the axis of movement of the single actuating bar.

5. The pressure mounting apparatus of claim 1, further comprising: a drawer moveably attached to the platform.

6. The pressure mounting apparatus of claim 5, wherein the drawer further comprises: a childproof lockable drawer.

7. The pressure mounting apparatus of claim 5, where in the drawer further comprises: a spice drawer.

8. The pressure mounting apparatus of claim 5, wherein the drawer further comprises: a crisper drawer.

9. The pressure mounting apparatus of claim 5, wherein the pressure mounting apparatus further comprises: no other apparatus attached to the platform.

10. The enclosure of claim 1, wherein the locking friction clamp expands to a width of the walls.

11. The enclosure of claim 1, wherein the locking friction clamp expands to a length of the walls.

12. An enclosure comprising:

a platform;

a plurality of walls mounted to the platform; and a locking friction clamp arranged along a second plane parallel to the first plane, the locking friction clamp having a single actuating bar connected by a center buckle to a pair of center snap arms, the pair of center snap arms including a first center snap arm and a second center snap arm, the first center snap arm having an inner end attached to the center buckle and an outer end attached to a first outer buckle, the second center snap arm having an inner end attached to the center buckle and an outer end attached to a second outer buckle, the first outer buckle attached to each inner end of a first pair of outer snap arms, each outer end of the first pair of outer snap arms having a snap compression pad, the second outer buckle attached to each inner end of a second pair of outer snap arms, each outer end of the second pair of outer snap arms having a snap compression pad, wherein the snap arms have a locked position and an unlocked position and wherein the snap arms hold the platform in position in an enclosure having at least two opposing walls by creating friction against the opposing walls of the enclosure with the snap compression pads while in the locked position, wherein the snap compression pads are not attached to the opposing walls of the enclosure using an attachment device and in the locked position the snap arms are rotated to a position beyond a straight line alignment to each other; and the single actuating bar applies equal mechanical pressure to each of the snap arms simultaneously.

13. The enclosure of claim 12, wherein the locking friction clamp expands to a width of the walls.

14. The enclosure of claim 12, wherein the locking friction clamp expands to a length of the walls.

15. The enclosure of claim 14, further comprising: a level permanently attached to the platform.

* * * * *